US010600267B2

(12) United States Patent
Hara

(10) Patent No.: US 10,600,267 B2
(45) Date of Patent: Mar. 24, 2020

(54) STORAGE APPARATUS AND STORAGE SYSTEM

(71) Applicant: Shuhei Hara, Tokyo (JP)

(72) Inventor: Shuhei Hara, Tokyo (JP)

( * ) Notice: Subject to any disclaimer, the term of this patent is extended or adjusted under 35 U.S.C. 154(b) by 0 days.

(21) Appl. No.: 16/108,708

(22) Filed: Aug. 22, 2018

(65) Prior Publication Data

US 2020/0066077 A1 Feb. 27, 2020

(51) Int. Cl.
*G07C 9/00* (2020.01)
*E05B 47/00* (2006.01)

(52) U.S. Cl.
CPC ..... *G07C 9/00309* (2013.01); *E05B 47/0001* (2013.01); *G07C 9/00563* (2013.01); *G07C 9/00571* (2013.01); *G07C 9/00896* (2013.01); *E05B 2047/0071* (2013.01); *G07C 2009/00936* (2013.01)

(58) Field of Classification Search
None
See application file for complete search history.

(56) References Cited

U.S. PATENT DOCUMENTS

2012/0086314 A1* 4/2012 Bourke ..... G07F 17/10 312/109
2018/0190054 A1* 7/2018 Perez ..... G07C 9/00309

FOREIGN PATENT DOCUMENTS

JP 05-176834 7/1993
JP 2017-145105 8/2017

* cited by examiner

*Primary Examiner* — Daniell L Negron
(74) *Attorney, Agent, or Firm* — Odedra IP, PLLC

(57) ABSTRACT

Provided is a storage apparatus and a storage system having a plurality of storage boxes each having a plurality of deposit and retrieval ports for a delivery article, for example, on a front face side and a back face side, and capable of smooth work of deposit or retrieval of the delivery article in these storage boxes. A storage apparatus is composed of CPU or the like, and is configured to have a control section for controlling the whole storage apparatus, an information storage section for storing various pieces of information, a storage section for storing a delivery article addressed to a user, a display section for displaying various pieces of information, and an information input section provided with various keys, for enabling information input and for performing reading of information for authentication written in an information recording medium possessed by a user, and the like.

10 Claims, 19 Drawing Sheets

FIGURE 6

USER DB 121

| USER ID | NAME | PRIVATE SECTION INFORMATION (ROOM NUMBER) | E-MAIL ADDRESS |
|---|---|---|---|
| 0001 | ○○ ○○ | 101 | XXX@XXX |
| 0002 | ○○ ○○ | 306 | XXX@XXX |
| 0003 | ○○ ○○ | 505 | XXX@XXX |
| ⋮ | ⋮ | ⋮ | ⋮ |

FIGURE 7

USAGE SITUATION DB 122

| BOX IDENTIFYING INFORMATION | USAGE SITUATION | PRIVATE SECTION INFORMATION (ROOM NUMBER) |
|---|---|---|
| a | OCCUPIED | 502 |
| b | WORK IN PROGRESS | |
| c | VACANT | |
| d | VACANT | |
| e | VACANT | |
| f | VACANT | |
| g | VACANT | |
| ⋮ | ⋮ | ⋮ |

FIGURE 13

USAGE SITUATION DB 122

| BOX IDENTIFYING INFORMATION | USAGE SITUATION | PRIVATE SECTION INFORMATION (ROOM NUMBER) | GROUP |
|---|---|---|---|
| a | OCCUPIED | 502 | 1 |
| b | WORK IN PROGRESS | | 1 |
| c | VACANT | | 1 |
| d | VACANT | | 2 |
| e | VACANT | | 2 |
| f | VACANT | | 2 |
| g | VACANT | | 2 |
| ⋮ | ⋮ | ⋮ | ⋮ |

STORAGE APPARATUS AND STORAGE SYSTEM

STATEMENT REGARDING PRIOR DISCLOSURE BY THE INVENTOR

Japanese Publication No. 2017-145105 dated Aug. 24, 2017 is a grace period inventor-originated disclosure which qualifies as an exception under 35 USC § 102(b)(1).

TECHNICAL FIELD

The present invention relates to a storage apparatus and a storage system, and in particular to a storage apparatus and a storage system having a plurality of storage boxes provided with a plurality of deposit and retrieval ports.

BACKGROUND ART

In recent years, an increase of nuclear families, and unmarried persons/late married persons, an increase in the number singles due to an aging population and a declining birth rate, an increase in the number of dual-income couples, and the like, have advanced, and our lifestyles have been changing significant.

Further, in recent years, while an increasing number of articles such as purchased products have been delivered to respective homes with the prosperity of E-commerce, more and more people have tended to be absent from their homes because of an increase in the percentage of dual-income couples, as described above, so that environments or facilities enabling them to receive the articles smoothly have been demanded.

In order to satisfy such needs as described above, more and more apartment house such as apartment buildings have installed storage apparatuses referred to as so-called home delivery lockers in their common areas or the like.

The storage apparatus is such that a delivery article addressed to a resident of an apartment house by a home delivery service or the like is temporarily kept and stored in a lockable manner the resident can receive the delivery article smoothly by taking the article addressed to the resident himself/herself out of the storage apparatus without asking for redelivery even if the resident is absent.

As one of conventional techniques relating to a storage apparatus for temporarily receiving and keeping a delivery article addressed to a resident described above or the like, an automatic managing locker apparatus for baggage or the like, which is disclosed in PTL 1 has been proposed.

The locker apparatus disclosed in PTL 1 is installed in a shared entrance or the like of an apartment house, and is provided with a plurality of storage boxes, each of the storage boxes being provided with openable/closable doors on both front and back face sides.

In the locker apparatus, a delivery article can be put in and taken out from the front face side without passage through an automatically lockable door of the shared entrance. On the other hand, the delivery article cannot be taken out from the back face side without passage through the automatically lockable door of the shared entrance.

CITATION LIST

Patent Literature

[PTL 1] Japanese Patent Application Laid-Open No. H05-176834

SUMMARY

Problem to be Solved

However, the locker apparatus provided with the doors on both the faces has a problem that, though keys or panels for depositing and retrieving operations are individually provided on both the sides, while the delivery article is being deposited or retrieved by performing the above key operation or the like on one of both the sides, an operation for depositing or retrieving a delivery article is inhibited on the other side and therefore cannot be performed.

This is due to the apprehension that, for example, while a delivery person or the like is opening a storage box from the front face side to deposit a delivery article in the storage box, a resident or the like may open the storage box in the deposit work the door from the opposite side (the back face side), but use of storage boxes other than the storage box in the deposit work is also inhibited, which results in significant inconvenience of convenience.

In particular, in recent years, due to an increase in the delivery amount of delivery articles, scaling-up of apartment house, and the like, it has not been uncommon that a long time is required for work of depositing articles, so that while work of depositing a delivery article is in progress for a long time on the one side, the residents must wait to retrieve delivery articles addressed to them on the opposite side.

The present invention has been made in view of the above problem, and an object thereof is to provide a storage apparatus and a storage system having a plurality of storage boxes provided with a plurality of deposit/retrieval ports for delivery articles arranged on such sides as front face and back face sides, for example, and capable of smooth work of deposit or retrieval of delivery articles in these storage boxes.

In order to achieve such an object, the present invention is characterized in that a storage apparatus for temporarily receiving and keeping an article, including: a storage section having a plurality of lockable and unlockable storage boxes each having a storage chamber for storing and keeping an article, a plurality of deposit and retrieval ports opened on sides different from each other in the storage chamber, and a plurality of openable and closable doors for closing the deposit and retrieval ports, respectively; and a locking and unlocking section for locking and unlocking the storage boxes individually.

Further, the storage apparatus in the present invention is characterized in that the deposit and retrieval ports are provided on sides opposite to each other in the storage chamber.

Further, the storage apparatus in the present invention is a storage apparatus for temporarily receiving and keeping an article, characterized by including: a storage section having a plurality of lockable and unlockable storage boxes each provided with a plurality of deposit and retrieval ports, the deposit and retrieval ports being each closed by openable and closable doors; a locking and unlocking section for locking and unlocking the storage boxes individually and detecting situations of opening or closing of the doors; a control section having a CPU for controlling an action of the storage apparatus; and a database for managing usage situations of the storage boxes, wherein when the control section recognizes, on a basis of the database, that work of deposit or retrieval of an article is being performed at one of the deposit and retrieval ports of one of the storage boxes, the control section outputs a locking signal for the door of another deposit and retrieval port of the deposit and retrieval ports of the storage box to the locking and unlocking section to restrict deposit or retrieval of an article regarding the another deposit and retrieval port, and outputs a door unlocking signal regarding another box of the storage boxes to allow deposit or retrieval of an article.

Further, according to the storage apparatus in the present invention, the storage apparatus is characterized in that when the control section recognizes that work of deposit or retrieval of an article is being performed at one deposit and retrieval port of one of the storage boxes, the control section outputs, regarding the another storage box, a door unlocking signal regarding another deposit and retrieval port by using an operation unit different from an operation unit used when work is performed at the deposit and retrieval port where the work is being performed to allow deposit or retrieval of an article at the another deposit and retrieval port.

Further, according to the storage apparatus in the present invention, the storage apparatus is characterized in that when the control section recognizes that work of deposit or retrieval of an article is being performed at one of the deposit and retrieval ports of one of the storage boxes, the control section outputs, regarding the another storage box, a door unlocking signal regarding another deposit and retrieval port which is not provided on substantially the same face as the deposit and retrieval port where the work is being performed to allow deposit or retrieval of an article at the another deposit and retrieval port.

In addition, according to a storage apparatus in the present invention, a storage apparatus for temporarily receiving and keeping an article is characterized by including: a storage section having a plurality of lockable and unlockable storage boxes each provided with a plurality of deposit and retrieval ports, the deposit and retrieval ports being each closed by openable and closable doors; a locking and unlocking section for locking and unlocking the storage boxes individually and detecting situations of opening or closing of the doors; a control section having a CPU for controlling an action of the storage apparatus; a database for allocating the plurality of storage boxes to a plurality of groups, respectively, and managing of usage situations of the storage boxes, and a plurality of storage control sections each having a CPU for performing an action control of storage boxes for each of the groups, wherein when the control section recognizes, on a basis of the database, that work of deposit or retrieval of an article is being performed at one of the storage boxes, the control section does not output an action control signal to the storage control section for performing an action control of the group to which the storage box where the work is being performed is allocated, and restricts deposit or retrieval of an article regarding all other storage boxes belonging to the group, and outputs an action control signal to the storage control section for performing an action control of another group of the groups to which the storage box where the work is being performed is not allocated to allow deposit or retrieval of an article regarding the storage boxes in the another group.

Further, according to the storage apparatus in the present invention, the storage apparatus is characterized in that when the control section recognizes that work of deposit or retrieval of an article is being performed at one of the deposit and retrieval ports of a storage box of the plurality of storage boxes, the control section allows, regarding the another storage boxes, deposit or retrieval of an article at a deposit and retrieval port using an operation unit different from an operation unit used when the work is performed at the deposit and retrieval port where the work is being performed.

Further, according to the storage apparatus in the present invention, the storage apparatus is characterized in that when the control section recognizes that work of deposit or retrieval of an article is being performed at one of the deposit and retrieval ports of the storage box, the control section allows deposit or retrieval of an article at another deposit and retrieval port which is not provided on substantially the same face as the deposit and retrieval port where the work is being performed regarding the storage boxes allocated to the another group.

In addition, the present invention is a storage system having a storage apparatus having a plurality of storage boxes provided with a plurality of deposit and retrieval ports, and a management apparatus connected to the storage apparatus via a network, characterized in that the storage apparatus has a storage section having a plurality of lockable and unlockable storage boxes each provided with a plurality of deposit and retrieval ports for temporarily receiving and keeping an article, the deposit and retrieval ports being each closed with openable and closable doors, and a locking and unlocking section for performing locking and unlocking each of the storage boxes and detecting situations of opening or closing of the doors, and the management apparatus has a control section having a CPU for controlling an action of the storage apparatus, and a database for managing usage situations of the storage boxes, wherein when the control section recognizes that work of deposit or retrieval of an article is being performed at one of the deposit and retrieval ports of the storage box, the control section restricts one of the deposit or retrieval of an article at another deposit and retrieval port of the storage box, and transmits control information indicating that the doors are allowed to be unlocked to deposit or retrieve an article regarding another storage box to the storage apparatus make the storage apparatus to execute the control information.

Further, the present invention is a storage system configured to have a storage apparatus having a plurality of storage boxes and a management apparatus connected to the storage apparatus via a network, characterized in that the storage apparatus has a storage section having a plurality of lockable and unlockable storage boxes each provided with a plurality of deposit and retrieval ports for temporarily receiving and keeping an article, the deposit and retrieval ports being each closed with openable and closable doors, and a locking and unlocking section for locking and unlocking each of the storage boxes and detecting situations of opening or closing of the doors, and the management apparatus has a control section having a CPU for controlling an action of the storage apparatus, a database for allocating the plurality of storage boxes to a plurality of groups and managing usage situations of the storage boxes, and a plurality of storage control sections each having a CPU for performing an action control of storage boxes for each of the groups, and when the control section recognizes, on a basis of the database, that work of deposit or retrieval of an article is being performed at one of the deposit and retrieval ports of the storage box, the control section does not output an action control signal to a storage control section for performing the action control of a group to which the storage box where the work is being performed is allocated to restrict deposit or retrieval of an article regarding all other storage boxes belonging to the group, and outputs an action control signal to a storage control section for performing the action control of another group to which the storage box where the work is being performed is not allocated to allow deposit or retrieval of an article regarding the storage boxes in the another group.

It is to be noted that aspects of the preset invention include any combination of the constituent elements described above and/or a method, an apparatus, a system, a computer program, a recording medium storing the computer program, or the like, between which the constituent elements and/or expressions of the present invention are interchanged.

Advantageous Effect

In the present invention, since a storage apparatus having a plurality of storage boxes each provided with a plurality of deposit and retrieval ports, is configured such that when it is recognized that the work of deposit or retrieval of an article is being performed one of the deposit and retrieval ports of one storage box of the plurality of storage boxes, deposit or retrieval of an article is restricted regarding the other deposit or retrieval port of the storage box, and deposit or retrieval of an article is allowed regarding the other storage boxes, it is possible to perform the work of deposit or retrieval of delivery articles smoothly in the storage boxes.

BRIEF DESCRIPTION OF DRAWINGS

FIG. 6 is a table showing a data configuration of a user DB in the first embodiment of the present invention;

FIG. 7 is a table showing a data configuration of a usage situation DB in the first embodiment of the present invention;

FIG. 13 is a table showing one example of a data configuration of a usage situation DB in the second embodiment of the invention;

DETAILED DESCRIPTION

First Embodiment (Summary of First Embodiment)

Figure 1:
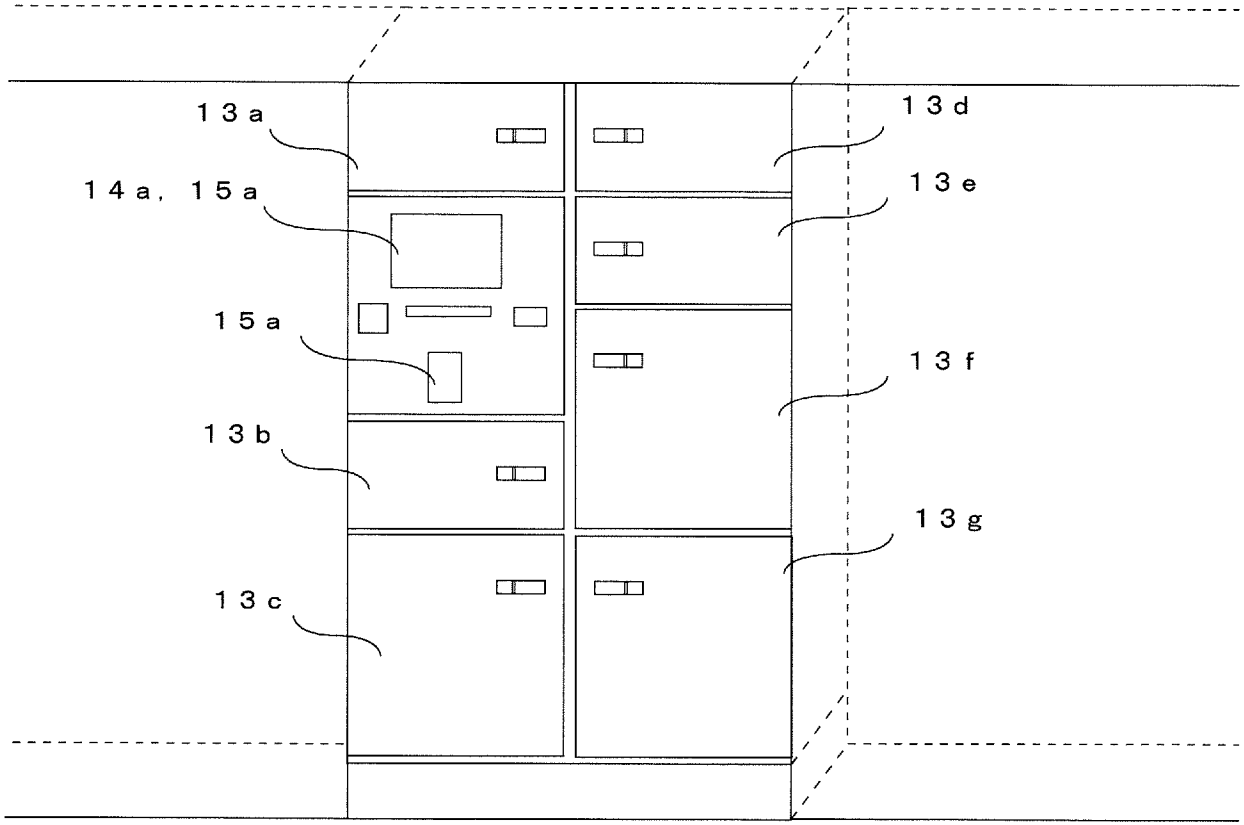
FIG. 1 is an isometric view showing an appearance of a storage apparatus in a first embodiment of the present invention as viewed from the front of the storage apparatus.

A storage apparatus 10 is a storage apparatus for temporarily receiving an article addressed to a user until the user receives the article, and is provided with a plurality of lockable storage boxes.

Each storage box is individually provided with a plurality of deposit and retrieval ports, and an article can be deposited or retrieved through each of the deposit and retrieval ports.

The storage apparatus 10 may be installed at an office, a store such as a convenience store/a supermarket, a commercial facility, or public facility/institution such as a station, a hospital or the like, in addition to an apartment house such as a condominium and an installation place thereof is not limited to these places.

The storage apparatus 10 can receive and keep any article in addition to a delivery article such as an article performed by a home delivery service or the like.

For example, a user uses the storage apparatus 10 to use of a dry-cleaning service.

At this time, the user deposits his/her own uncleaned clothes in the storage apparatus 10, a dry-cleaning service person recovers and cleans the received clothes, and stores the cleaned clothes in the storing apparatus 10, and thereafter, the user retrieves the cleaned clothes from the storage apparatus 10.

Further, the user can also use the storage apparatus 10 to use a grocery delivery service from a supermarket, a convenience store or the like.

At this time, a courier delivers groceries ordered by the user and deposits them in the storage apparatus 10, and the user retrieves the groceries from the storage apparatus 10.

Further, the user can use the storage apparatus 10 to rent equipment deposited in an apartment house or the like.

For example, when the storage apparatus 10 is installed in an apartment house, the storage apparatus 10 stores equipment used in the apartment house (a key of a meeting room, a pump, a key of a cart or a rental cycle, or the like).

The user retrieves a stored equipment from the storage apparatus 10 and uses the same, and returns the equipment to the storage apparatus 10 after use and stores the same again.

Furthermore, the user uses the storage apparatus 10 to use a rental car service of a home delivery type.

In this case, the user requests a car rental agency for a rental car a staff or the like of the car rental agency delivers a car to a predetermined parking lot and deposits and stores a key of the car in the storage apparatus 10.

The user retrieves the key of the car from the storage apparatus 10, uses the key to use the car, and redeposits and stores the key in the storage apparatus 10 after use.

Thereafter, the staff or the like of the car rental agency retrieves the key of the car stored in the storage apparatus 10 to repossess the key, and brings the key back together with the vehicle after used up to a his/her business office.

As described above, the storage apparatus 10 can be used for various services used by a user, but in this embodiment, as one example, the storage apparatus 10 is described in the following description as a storage apparatus installed in a common space of an apartment house for being used for the services of temporary deposit of a delivery article addressed to a user who is a resident of the apartment house in such a case as when the user is absent and therefore cannot receive the delivery article addressed to the user.

(Configuration of First Embodiment)

(1) Configuration of Storage Apparatus 10

FIG. 1 is an isometric view showing an appearance of the storage apparatus 10 in a first embodiment of the present invention as viewed from a front face side.

Figure 2:
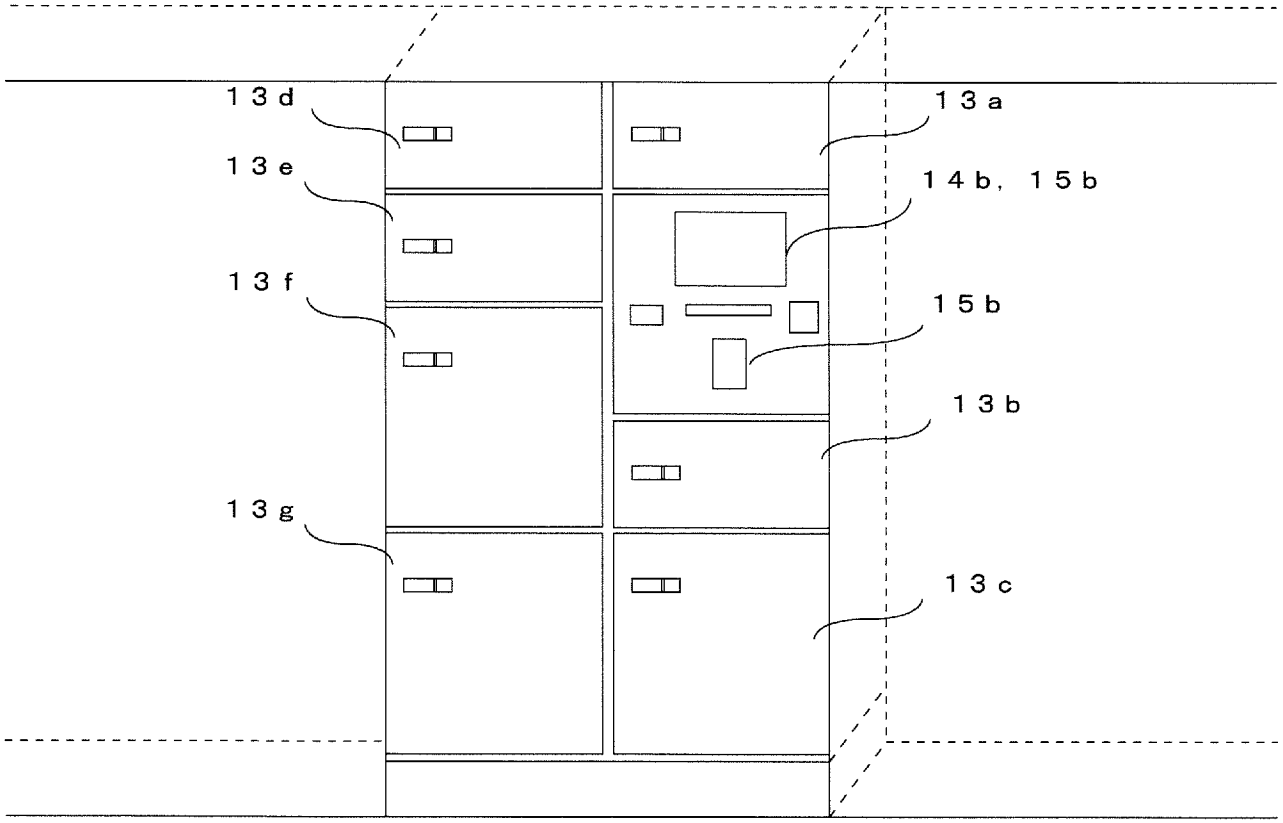
FIG. 2 is an isometric view showing an appearance of the storage apparatus in the first embodiment of the present invention as viewed from the back of the storage apparatus.

Further, FIG. 2 is an isometric view showing an appearance of the storage apparatus 10 in the first embodiment of the present invention as viewed from a back face side.

Figure 3:
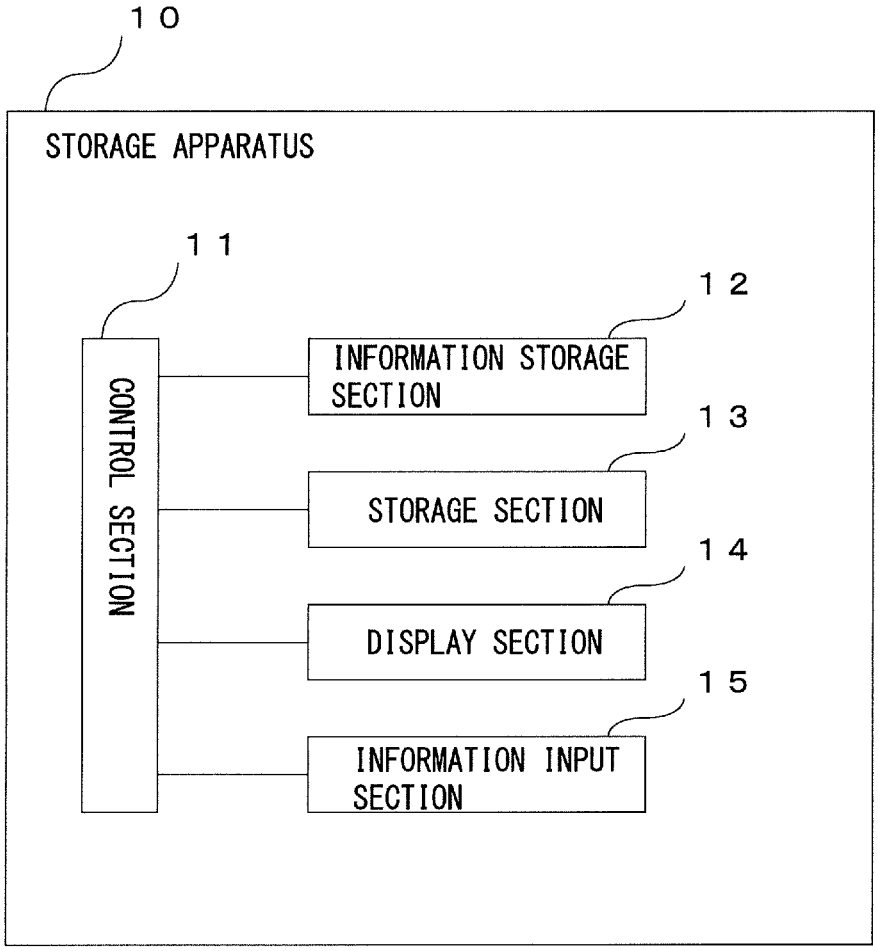
FIG. 3 is a diagram showing a configuration of the storage apparatus in the first embodiment of the present invention.

Furthermore, FIG. 3 is a block diagram showing a configuration of the storage apparatus 10 in the first embodiment of the present invention.

Hereinafter, a configuration of the storage apparatus 10 is described with reference to these figures.

As shown in the figures, the storage apparatus 10 is configured to have a control section 11 composed of a CPU and the like for controlling the entire storage apparatus 10, an information storage section 12 for storing various pieces of information therein, a storage section 13 provided with a plurality of storage boxes for storing an article addressed to a user, a display section 14 (including display sections 14*a*, 14*b* described later) for displaying the various pieces of information, and an information input section 15 (including information input sections 15*a*, 15*b* described later) provided with various keys to enable information input for performing reading information for authentication for unlocking a storage box, or the like.

Each of the sections 11 to 15 are connected to an internal bus, is inputted/outputted with various pieces of information via the bus, and various kinds of processing are performed under control of the control section 11.

A courier performs the operation of delivery of a delivery article addressed to a user.

When the user is absent at the time of delivery, the courier temporarily deposits the delivery article addressed to the user in a storage box of the storage apparatus 10 installed near a shared entrance of an apartment house where the user resides.

The storage box is normally locked.

The courier unlocks a vacant storage box not storing an article at the time of delivery, such as by operating the information input section 15, then deposits the delivery article addressed to the user in the unlocked storage box, and thereafter locks the storage box.

Thus, since the courier can deposit the delivery article in the storage apparatus 10 even if the recipient user is absent, the courier can eliminate the troublesome work of bringing back the delivery article and redelivering the same, which can achieve an improvement in the efficiency of a delivery work.

The user confirms whether or not a delivery article addressed to be the user himself/herself is stored in the storage apparatus 10 when user returns to the apartment house where the user himself/herself resides, and if the article is stored, the user operates the information input section 15 to perform authentication, and the storage apparatus 10 unlocks the storage box storing the delivery article addressed to the user when the authentication is successful.

The user can retrieve the delivery article addressed to the user stored in the above unlocked storage box.

Further, when the user would like to request a delivery of a delivery article, the user unlocks a vacant storage box in the storage apparatus 10, deposits the delivery article in the storage box and locks the storage box.

Thereafter, a courier performs authentication by operating the information input section 15, and the storage apparatus 10 unlocks the storage box storing the delivery article requested by the user when the authentication is successful.

The courier retrieves the delivery article to deliver the same to an address written in the delivery article.

In this way, when the user requests delivery, the user is not required to bring a delivery article into a courier office or to wait until the courier comes to pick up the delivery article, so that the user can always request delivery of a delivery article.

The delivery articles described above includes an uncleaned item such as clothes requested for dry-cleaning by a user.

When the user requests dry-cleaning of the user's clothes, the user unlocks an vacant storage box in the storage apparatus 10, deposits the uncleaned item in the storage box and locks the storage box.

A courier (including a dry-cleaner) operates the information input section 15 to perform authentication, and the storage apparatus 10 unlocks the storage box storing the uncleaned item when the authentication is successful.

The courier retrieves the above uncleaned item from the storage box and delivers the uncleaned item to an office or a dry-cleaning factory of the dry-cleaner.

Thereafter, when cleaning work is completed on the side of the dry-cleaner, the courier delivers the finished cleaning item to the storage apparatus 10.

The courier unlocks a vacant storage box not storing an article, such as by operating the information input section 15, then deposits the cleaned item in the unlocked storage box, and thereafter locks the storage box.

In this manner, since the courier can deposit the cleaned item in the storage apparatus 10 even if the recipient user to be delivered is absent, the courier can eliminate the troublesome work of bringing back the cleaned item and redelivering the same, which can achieve an improvement in efficiency of a delivery work.

Further, when the user requests dry-cleaning, the user is not required for bringing a delivery article into an office of a courier (a dry-cleaner) or waiting until the courier (a dry-cleaner) comes to pick up the item, so that the user can always request dry-cleaning.

The storage boxes in the storage apparatus 10 can be shared by a plurality of users residing in the same apartment house. That is, articles addressed to a plurality of users residing in the same apartment house can be stored in the respective storage boxes in the storage apparatus 10.

In the case where a delivery article addressed to a user has already been deposited in a storage box of the storage apparatus 10 and the door has been closed and locked, only the user (including a user residing in the same room) can unlock the storage box in the storage apparatus 10 and a user residing in another room or the courier cannot unlock the storage box.

The storage box of the storage apparatus 10 cannot store another article until the storage box is once cleared by retrieving a stored article and then becomes vacant.

(2) Installation Place of Storage Apparatus 10

Figure 4:
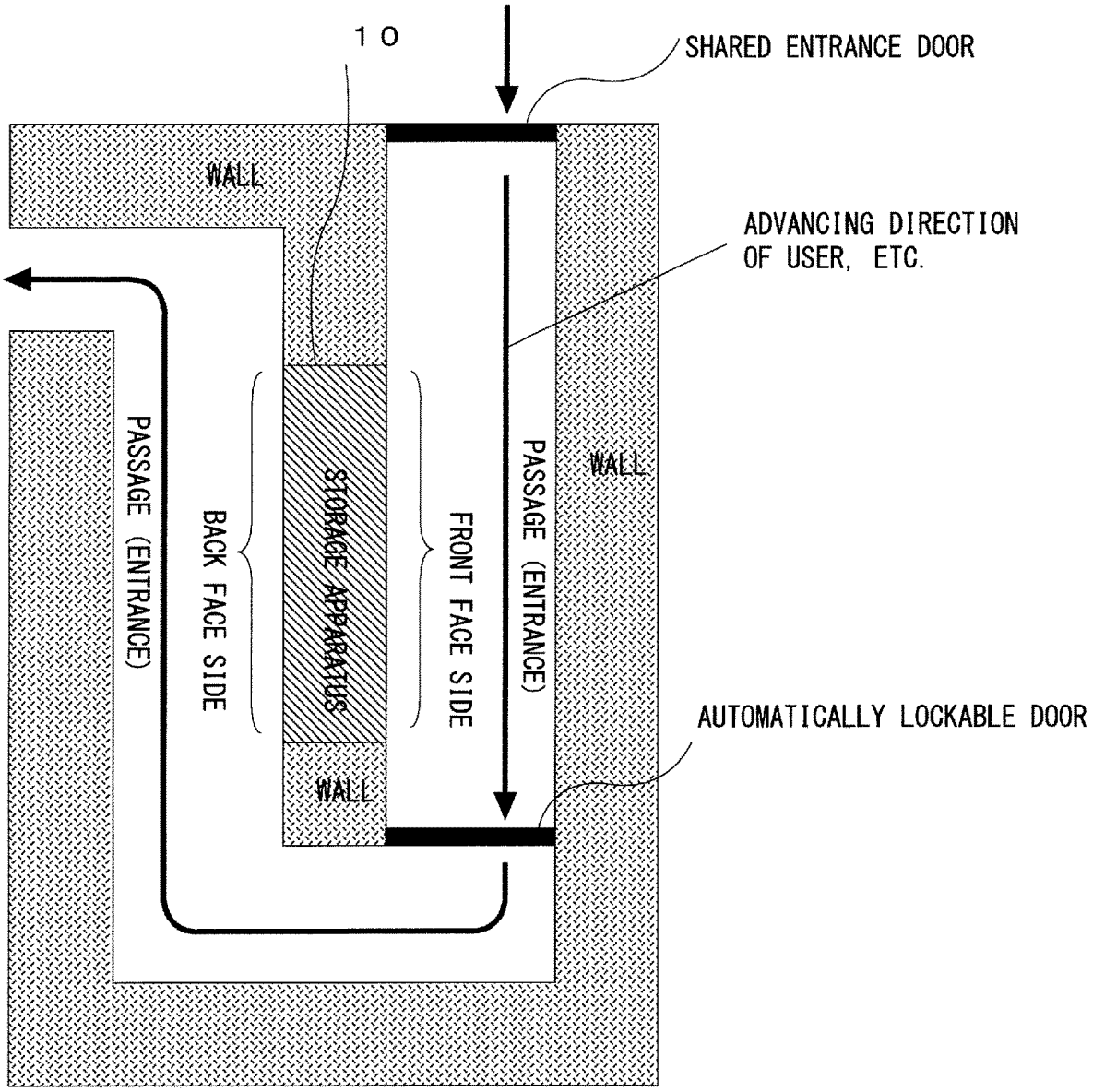
FIG. 4 is a top view showing one example of an installation place of the storage apparatus 10 in the first embodiment of the present invention.

FIG. 4 is a top view showing one example of an installation place of the storage apparatus 10 in the first embodiment of the present invention.

In the example shown in FIG. 4, in this embodiment, the storage apparatus 10 is supposed to be installed at a shared entrance which is a common area of an apartment house and deposit and retrieval ports are provided on both front and back face sides.

Further, an automatically lockable door is provided at the shared entrance, and a user can unlock the door using a key carried with the user himself/herself or a password number to pass through the door, pass in a front of the storage apparatus 10, unlock the door, and get behind the storage apparatus 10 in a turning manner.

It is to be noted that, in this example, in principle, a courier is supposed to deposit or retrieve a delivery article in or from the storage apparatus 10 from the front face side without unlocking the automatically lockable door. On the other hand, a user who resides in the apartment house can deposit or retrieve a delivery article in or from the front face side of the storage apparatus 10 and can also unlock the automatically lockable door to pass through the door and perform deposit or retrieval from the back face side.

(3) Configuration of Control Section 11

The control section 11 is a processing section for governing control of the whole storage apparatus 10, and is composed of an electronic circuit such as a CPU (Central Processing Unit), and/or an integrated circuit such as FPGA (Field-Programmable Gate Array).

The control section 11 reads information from the information storage section 12 and writes information in the information storage section 12.

The control section 11 performs an action control of a storage box such as locking/unlocking or opening/closing a door, an authentication processing in use of the storage apparatus 10, management of personal information of a user and a usage situation of each storage box, and the like.

(4) Configuration of Information Storage Section 12

The information storage section 12 is an apparatus for storing information, such as a hard disk, a memory, or a semiconductor device.

The information storage section 12 has an area storing a program executed by the control section 11, a work area temporarily used when the control section 11 performs a processing, and the like (RAM and the like).

The control section 11 reads a program stored in the information storage section 12, and develops the program in the work area to execute various kinds of processing.

The information storage section 12 stores various databases described later.

Figure 5:
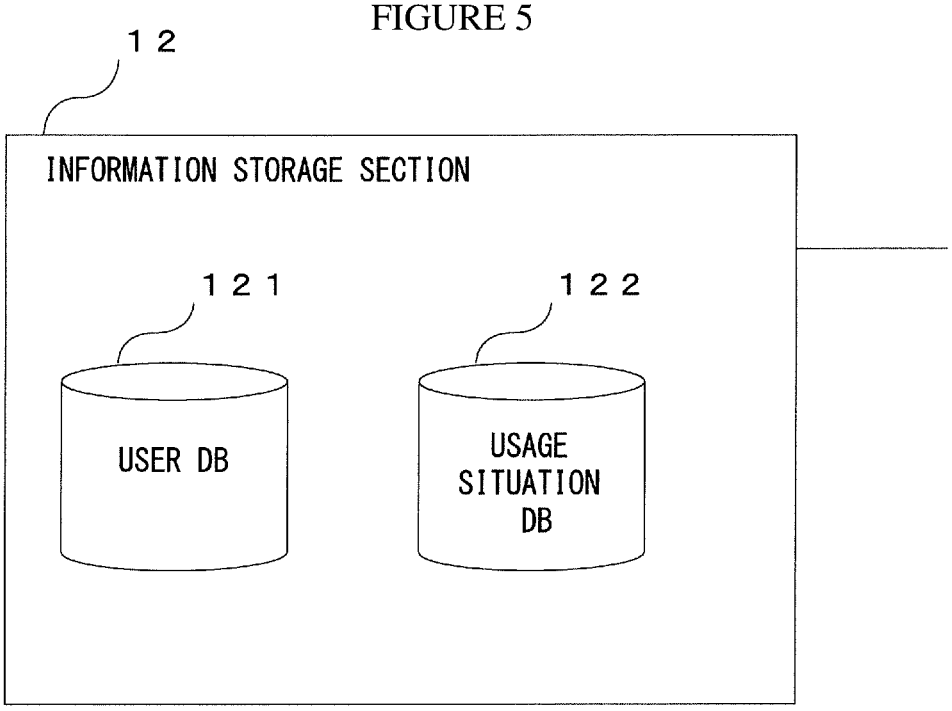
FIG. 5 is a diagram showing each database stored in an information storing section in the first embodiment of the present invention.

FIG. 5 is a diagram showing individual databases 121, 122 stored in the information storage section 12 in the first embodiment of the present invention.

As shown in FIG. 5, the information storage section 12 stores a user DB 121 for managing authentication information such as a password required when a user unlocks the storage section 13 and a usage situation DB 122 for managing usage situation of a plurality storage boxes constituting the storage section 13.

FIG. 6 is a table showing a data configuration of the user DB 121 in the first embodiment of the present invention.

In the example shown in FIG. 6, the user DB 121 stores a user name, a private section information identify a private section of a user (a room number of a dwelling unit where a user resides in an apartment house in this embodiment), a password for authentication, and an E-mail address in such a manner that each of them is associated with an individual ID identifying a user (user ID).

Further, in the example shown in FIG. 6, the user DB 121 manages the E-mail address as information of a contact address (a user terminal or the like) of a user, but the information is not limited to an E-mail address as long as it is a contact address.

Further, FIG. 7 is a table showing a data configuration of the usage situation DB 122 in the first embodiment of the present invention.

In the example shown in FIG. 7, the usage situation DB 122 is a database for managing usage situations of each storage box in association with box identification information for identifying each box storing a deposited delivery article.

In this example, the storage section 13 is composed of seven storage boxes, and box identification information "a" to "g" are given to the respective storage boxes.

These box identification information corresponds to storage boxes 13*a* to 13*g* shown in FIGS. 2 and 3.

Further, as shown in FIG. 7, "usage situation" in the usage situation DB 122 involves three statuses of "occupied", "work in progress", and "vacant", and the control section 11 (CPU) writes any one of these statuses on a basis of a detection result obtained by an article detection section 135, described later, provided in each storage box, or the like.

In a case where a storage box is storing an article and the door is closed and locked, the control section 11 (CPU) writes the usage situation of the storage box as "occupied". In this case, the control section 11 (CPU) also writes the private section information of a user to which the article is addressed in association with the box identification information of the corresponding storage box.

On the other hand, in a case where a storage box is not storing an article and the door is closed, the control section 11 (CPU) writes the usage situation of the storage box as the "vacant".

Further, in a case where the door of the storage box is opened in order for a user or the like to deposit or retrieve an article regardless of whether or not the storage box is storing an article, the control section 11 (CPU) writes the usage situation of the storage box as "work in progress". When the work of depositing the article is completed and the door of the storage box is closed and locked again, the control section 11 (CPU) rewrites the usage situation of the storage box to the "occupied". On the other hand, when the work of retrieving the article is completed, and the door of the storage box is closed again, the control section 11 (CPU) rewrites the usage situation of the storage box to the "vacant".

It is to be noted in this embodiment that the "work" is supposed to include the works of depositing an article and the retrieving the same.

(Configuration of Storage Section 13)

The storage section 13 is composed of a plurality of storage boxes.

The storage boxes are storage compartments for temporarily keeping a delivery article addressed to user, and is configured to be lockable and unlockable.

For example, even if a user is absent, a courier person in charge of the delivery deposits a deliver article addressed to the user in the storage box and locks the storage box, and thereby the storage section 13 safely keeps the delivery article or the like until the user retrieves the delivery article or the like.

Though a structure for achieving locking and unlocking of a storage box including a locking and unlocking section 134 described later is not particularly limited as long as it fastens doors 133*a*, 133*b* to the storage chamber 131 so as to close deposit and retrieval ports 132*a*, 132*b*, one example of the structure for locking and unlocking is described below.

In the example shown in FIGS. 1 and 2, the storage apparatus 10 has the storage boxes 13*a* to 13*g*. These respective storage boxes 13*a* to 13*g* are shared by both faces of front and back face sides of the storage apparatus 10. That is, each of the storage boxes 13*a* to 13*g* is provided with doors on both the faces of front face and back faces, and is configured to be lockable and unlockable and openable and closable on both the faces.

Next, a configuration of the storage box is described in detail.

Figure 8:
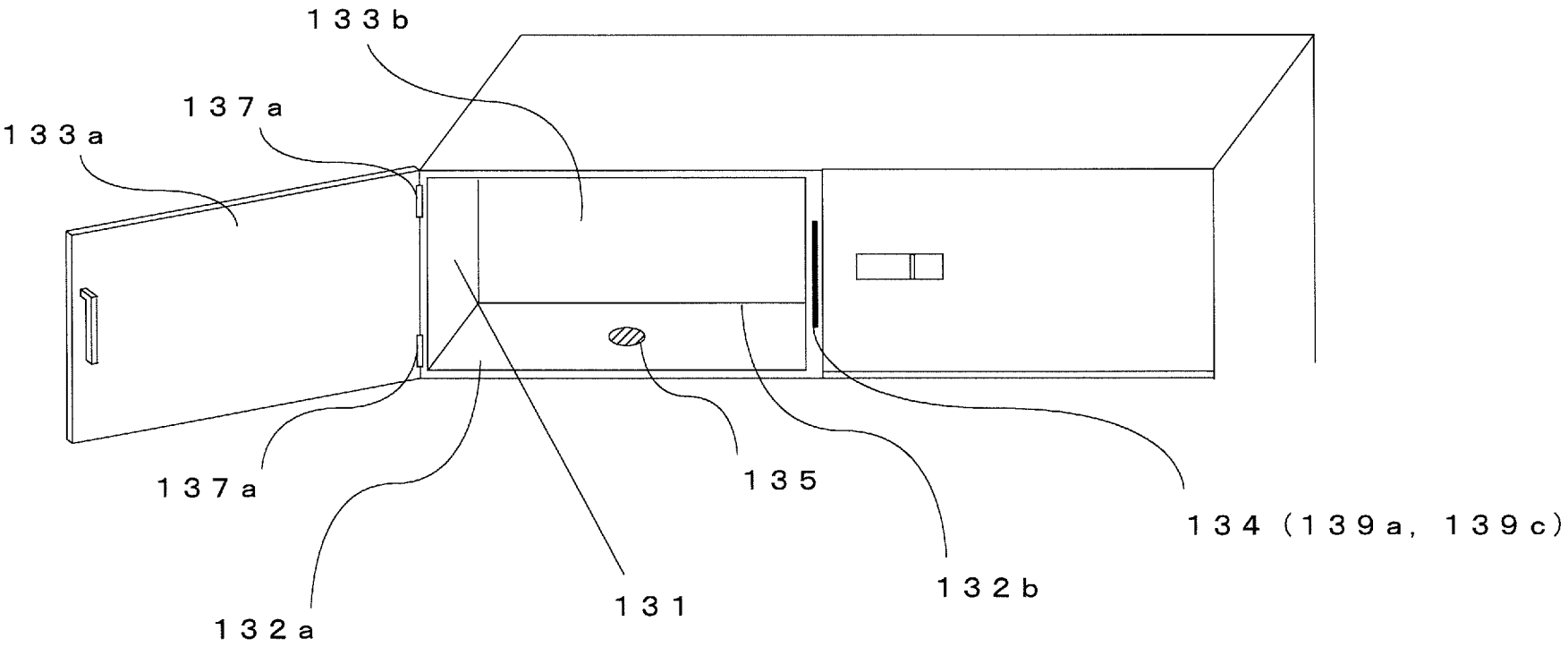
FIG. 8 is a view showing an appearance of a storage box in the first embodiment of the present invention.

FIG. 8 is a view showing an appearance of the storage box in the first embodiment of the present invention.

As shown in FIG. 8, the storage box has a storage chamber 131 which is a storage space for a delivery article addressed to a user or the like, the deposit and retrieval ports 132*a*,132*b* which are opened to the front face side and the back face side, respectively, and are deposit and retrieval port for a delivery article addressed to a user, doors 133*a* and 133*b* which are provided on the front face side and the back face side, respectively, and which are opening and closing members for closing the deposit and retrieval ports 132*a*, 132*b* during locking, a locking and unlocking section 134 which is composed of an electrical lock or the like, and which locks the above doors 133*a*, 133*b* having the deposit and retrieval ports 132*a*, 132*b* closed and unlocks the lock when an unlocking signal is inputted from the control section 131, an article detection section 135 for detecting that an article is being stored in the storage chamber 131, hinge portions 137*a*, 137*b* connecting the storage chamber 131 to the doors 133*a*, 133*b*, and hooks 138*a*, 138*b* attached to the back sides of the doors 133*a*, 133*b*.

The storage chamber 131 is a rectangular-parallelepiped-like box having a plurality of faces such as faces of the front face side and the back face side opened, for example.

The storage chamber 131 and the doors 133*a*, 133*b* are made from, for example, iron or another metal, or an alloy, and has such a strength that prevents them from being not easily destroyed from the outside when the doors are close.

The doors 133*a*, 133*b* are attached to the storage chamber 131 via the hinge portions 137*a*, 137*b*, respectively, in an openable and closable manner (the hinge portion 137*b* is not shown).

Further, the hooks 138*a*, 138*b* are attached to the back sides of the doors 133*a*, 133*b*, respectively (the hook 138*b* is not shown).

Biasing forces act on the doors 133*a*, 133*b* of the storage box in opening directions, and when the doors 133*a*, 133*b* are unlocked by the locking and unlocking section 134, the doors 133*a*, 133*b* automatically open.

Further, in a case where a user deposits an article in a storage box and locks the storage box, for example, the user closes the door 133*a* or 133*b* against the biasing force, and thereby locking is automatically performed.

The locking and unlocking section 134 has a general electronic lock, a mechanical lock, or the like, a type of which is not particularly limited.

In this embodiment, as one example, the locking and unlocking section is described below as having an electronic lock.

The locking and unlocking section 134 fastens the doors of a deposit and retrieval ports of the storage chamber having the deposit and retrieval port of the storage chamber closed during locking, and restrains the door from opening. In this case, an article stored in the storage box cannot be retrieved from the outside, and an article cannot be deposited in the storage box.

The locking and unlocking section 134 has hook holes 139*a*, 139*b* (the hook hole 139*b* is not shown) on both opening face sides (the front face side and the back face side) of the storage chamber 131 into which the above hooks 138*a*, 138*b* are inserted during closing door, respectively.

Further, the locking and unlocking section 134 has door-opening and door-closing detection section 139*c* in deep sides of the hook holes 139*a*, 139*b* that are sensors for detecting opening and closing of the doors 133*a*, 133*b*.

The door-opening and door-closing detection sections 139*c* have, for example, switch-like members, and when the hooks 138*a*, 138*b* are inserted into the hook holes 139*a* 139*b*, the switch-like members of the door-opening and door-closing sections 139*c* are pressed by distal ends of the hooks 138*a*, 138*b* inserted, and thereby the door-opening and door-closing detection sections 139*c* can detect that the doors 133*a* and 133*b* have been closed.

Further, the locking and unlocking section 134 has catching sections for catching the above inserted hooks 138*a*, 138*b* in the hook holes 139*a*, 139*b* to restrict their actions.

For example, the materials of the above hooks 138*a*, 138*b* and the catching sections are made from, but not limited to, metal.

For example, catching members for catching the above hooks 138*a*, 138*b* in the catching sections are composed of metal-made levers or the like, and causes the levers to abut on the hooks 138*a*, 138*b* to catch the hooks 138*a*, 138*b*, thereby restraining the door from opening.

The locking and unlocking section 134 is connected to the control section 11 via a communication cable or the like so as to be capable of communicating therewith.

When an unlocking request signal requesting unlocking of a storage box is inputted and the unlocking request is accepted, the control section 11 outputs an unlocking signal to the locking and unlocking section 134 of the corresponding storage box.

When the unlocking signal is inputted, the locking and unlocking section 134 performs such an action as operating the lever of the catching section to release the catching section to unlock the storage box.

When the storage box is locked, the locking and unlocking section 134 detects the locked state and transmits a locking detection signal to the control section 11. Further, the locking and unlocking section 134 (the door-opening and door-closing detection section 139*c*) detects an opened or closed state of the doors 133*a*, 133*b* and transmits a door-opening detection signal or a door-closing detection signal indicating the detected door-opening or door-closing state to the control section 11.

A procedure of opening and closing of the door 133*a* on the front face side is similar to the procedure of opening and closing the door 133*b* on the back face side.

The opening and closing of the door 133*a* on the front face side is described below on behalf of both the doors.

First of all, the procedure at the time of locking the storage box is described.

When the door 133*a* is closed to close the deposit and retrieval port 132*a*, the hook 138*a* attached to the back face of the door 133*a* is inserted into the hook hole 138*a* of the locking and unlocking section 134 provided on the front face side of the storage chamber 131, the distal end of the hook 138*a* presses the door-opening and door-closing detection section 139*c* provided in the deep side of the hook hole

138*a*, the door-opening and door-closing detection section 139*c* detects that the door 133*a* has been closed.

Here, when the door-opening and door-closing detection section 139*c* detects the above closing of the door, the door-opening and door-closing detection section 139*c* physically moves a member made from metal or the like such as a lever or a cam owned by the door-opening and door-closing detection section 139*c* itself, which may be used as a trigger to cause the locking and unlocking section 134 to output the door-closing detection signal to the control section 11.

When the door-opening and door-closing detection section 139*c* detects closing of the door 133*a*, the locking and unlocking section 134 operates the catching section provided in itself to catch and fasten the hook 138*a* inserted into the hook hole 139*a*, thereby restraining the door from opening to lock the storage box.

Next, a procedure of the storage box at the time of unlocking is described.

When unlocking of the storage box is requested and the request is accepted, the control section 11 generates an unlocking signal and outputs the same to the locking and unlocking section 134.

When the unlocking signal is inputted from the control section 11, the locking and unlocking section 134 moves the catching member of the catching section to release the caught hook 138*a* from the catching member to unlock the storage box.

When the hook 138*a* is released from the catching section, the door 133*a* can be freely opened.

Each storage box, in principle, is locked in both cases where a delivery article is stored and where a delivery article is not stored.

Once a delivery article is deposited in a storage box, the door is closed and the storage box is locked, and the delivery article is safely kept until a user to which the delivery article is addressed retrieves the delivery article from the storage box. When the delivery article is stored, authentication of the user to which the delivery article is addressed is performed, and the storage box is unlocked when the authentication is successful.

The article detection section 135 is a sensor for detecting that an article is being stored in the storage chamber 131.

The article detection section 135 is connected to the control section 11 via a communication cable or the like so as to be capable of communicating with the control section 11.

When the article detection section 135 detects that an article is being stored, the detection section 135 transmits an article detection signal to the control section 11.

When the control section 11 receives the above article detection signal, the locking detection signal, and the door-opening or door-closing detection signal, the control section 11 writes the status of the usage situation of the storage box in the usage situation DB 122 on a basis of each of these signals.

For example, the article detection section 135 is a general infrared sensor provided with a light emitter and a light receiver. In this case, the light emitter emits infrared into the storage chamber 131 and the light receiver receives the infrared. When an article is present in the storage chamber 131, the infrared emitted from the light emitter is blocked and cannot be received by the light receiver. At such a moment, the article detection section 135 can detect the article in the storage chamber 131.

Further, in a case where the light receiver is of a type receiving reflected light of the infrared emitted from the light emitter, when an article is present in the storage chamber 131, the infrared is reflected by a surface of the article and received at the light receiver so that the article detection section 135 can detect the presence of the article.

In addition, the article detection section 135 has a weight measuring machine, for example.

When the article detection section 135 is of a type having the weight measuring machine, the weight measuring machine is provided in a bottom face of the storage chamber 131, and when an article is deposited into the storage chamber 131, the weight measuring machine detects the weight of the article. Thereby, the article detection section 135 detects the presence of the article in the storage chamber 131.

(6) Configurations of Display Section 14 and Information Input Section 15

The display section 14 is a display apparatus such as a display, such as a liquid crystal panel or an organic EL panel (Electro Luminescence), or a lamp composed of a light emitting element as an LED.

The control section 11 reads an image from the information storage section 12 and performs an image output processing to generate image information.

The control section 11 outputs the above generated image information to the display section 14.

The display section 14 performs on-screen display of the above inputted image information on the display or the like.

Further, the control section 11 outputs a control signal to the display section 14 and can also light the lamp owned by the display section 14.

The information input section 15 is provided with an information input apparatus composed of, for example, various keys or the like, and the information input apparatus provides a pointing apparatus in cooperation with the display section 14. The information input section 15 receives various operations performed by a user or the like and outputs a signal indicating the content of the operation to the control section 11 or the like.

When the above signal indicating the content of the operation is inputted, the control section 11 outputs, in accordance with the content of the signal, a control signal indicating that on-screen display is performed in accordance with the content of the operation to the display section 14.

When the control signal is inputted, the display section 14 performs on-screen display in accordance with the control signal.

It is to be noted that the display section 14 and the information input section 15 may be integrally configured to form a touch panel.

Further, the information input section 15 is provided with an information reading apparatus for performing a short-range wireless communication such as infrared communication to read information from an information recording medium.

When a user brings the information recording medium having authentication information for unlocking of the above storage box to close within a predetermined distance such as by holding the same over the information input section 15 (the information reading apparatus), the information input section 15 reads the above authentication information from the information recording medium.

Though a technique for reading authentication information using the information input section 15 is not limited to a specific one, short-range wireless communication system, for example, Felica, MIFARE, NFC (Near Field Communication), Bluetooth or the like is used. Further, when code information is printed or provided on a surface of the information recording medium, the information input section 15 optically reads the code information.

The display section 14 has a display section 14*a* and a display section 14*b*.

Further, the information input section 15 has an information input section 15*a* and an information input section 15*b*.

In the example shown in FIGS. 1 and 2, the display section 14*a* and the information input section 15*a* are provided on the front face side of the storage apparatus 10, and the display section 14*b* and the information input section 15*b* are provided on the back face side opposite to the front face side.

Hereinafter, the display section 14 and the information input section 15 are collectively called as an operation unit 21.

The display section 14*a* and the information input section 15*a* provided on the front face side are collectively referred to as an operation unit 21*a* and the display section 14*b* and the information input section 15*b* provided on the back face side are collectively referred to as an operation unit 21*b*.

As described above, deposit and retrieval ports 133*a*, 133*b* for an article are provided on a front face side and a back face side, respectively, of each storage box, so that opening faces are present on both the front face side and the back face side.

Regarding each storage box, it is possible to deposit or retrieve an article from both the deposit and retrieval ports 133*a*, 133*b* unlocked, but regarding one storage box, the deposit and retrieval ports 133*a*, 133*b* are prevented from being unlocked simultaneously, so that an article can be deposited or retrieved at one time from only one deposit and retrieval port.

That is, when a work of depositing or retrieving an article is performed at one deposit and retrieval port of one storage box, the other deposit and retrieval ports in the storage box are locked, so that an article cannot be deposited or retrieved.

In this embodiment, however, it is possible to simultaneously perform the work of depositing or retrieving an article in or from another storage box at each of the deposit and retrieval port 133*a* on the front face side and the deposit and retrieval port 133*b* on the back face side.

The operation unit 21*a* is used when an article is deposited or retrieved at the deposit and retrieval port 133*a* on the front face side of the storage box of the storage apparatus 10, whereas the operation unit 21*b* is used when an article is deposited or retrieved at the deposit and retrieval port 133*b* on the back face side.

On the front face side, the work of depositing or retrieving an article to the storage box using the operation unit 21*a* can be performed at one time by only one person, and the work cannot be performed simultaneously by a plurality of persons.

Simultaneously, on the back face side, the work of depositing or retrieving an article to the storage box using the operation unit 21*b* can be performed at one time by only one person, and the work cannot be performed simultaneously by a plurality of persons.

On the other hand, when the work of depositing or retrieving an article on the front face side or the back face side is being in progress, the deposit or retrieval work can be performed on the opposite side (except for the same storage box).

It is to be noted that, in the example shown in FIGS. 1 and 2, the display section 14*a* and the information input section 15*a*, and the display section 14*b* and the information input section 15*b* are configured integrally on the front face side and the back face side, respectively, to form touch panels, but they may be separated and individually provided on the respective face sides.

Further, the information input sections 15*a*, 15*b* are provided with a function as an information reading means for reading information in the information recording medium possessed by a user via a short-range wireless communication in addition to numeric keypad or the like.

The above information recording medium is, for example, a contactless IC card where authentication information identifying a user is written, or a mobile terminal provided with a similar function.

(Procedure of First Embodiment)

(1) Procedure when an Article is Deposited in

Figure 9:
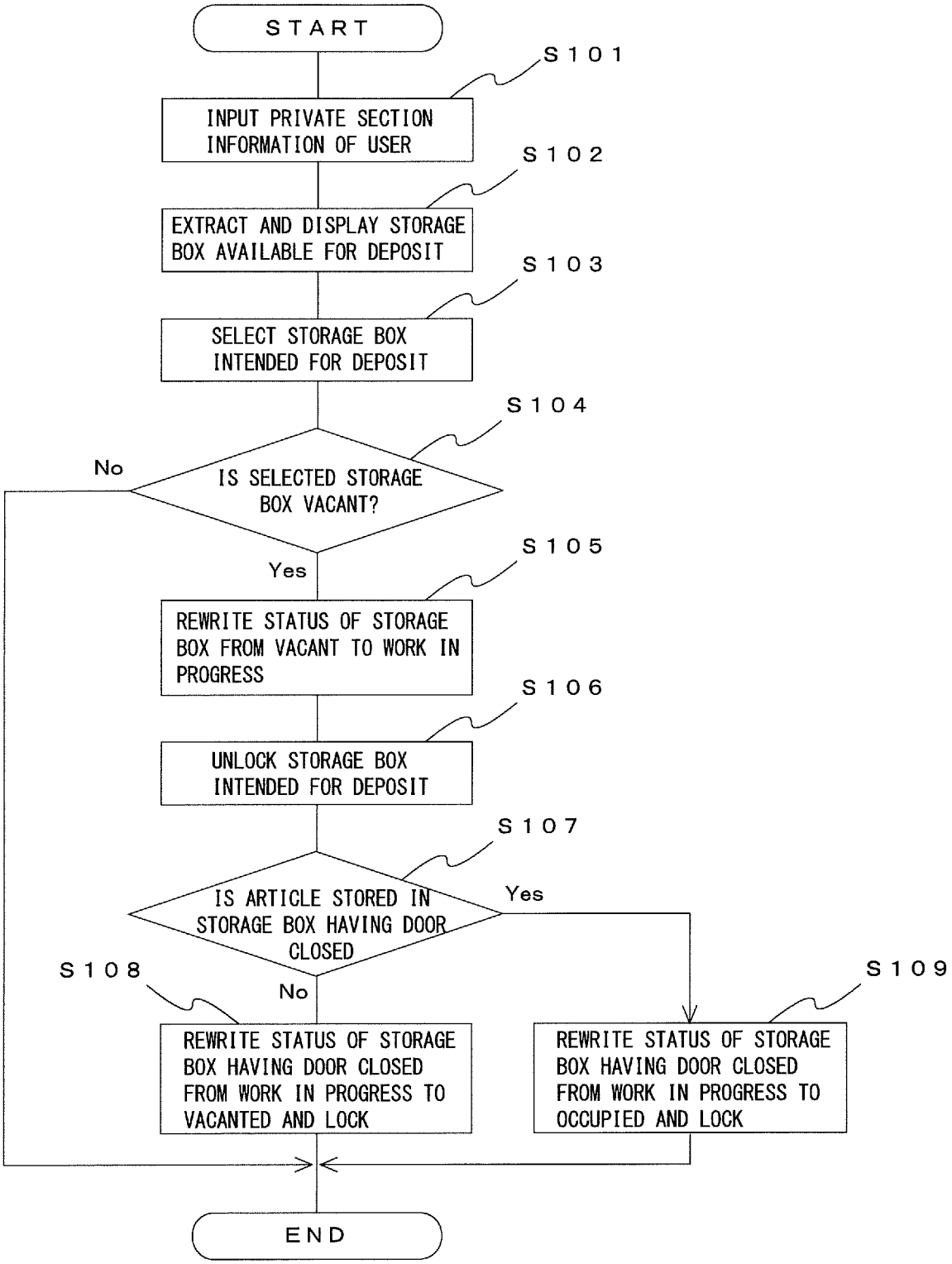
FIG. 9 is a flowchart showing a procedure flow of the storage apparatus at the time of deposit of an article in the first embodiment of the present invention.

FIG. 9 is a flowchart showing a flow of a procedure flow taken by the storage apparatus 10 when an article is deposited in the storage apparatus 10 in the first embodiment of the present invention.

Hereinafter, with reference to FIG. 9, a procedure taken at the time of depositing an article is described in an example where a courier deposits an article addressed to a user (a delivery article) in the storage apparatus 10.

A courier having a delivery article first visits an entrance of an apartment house installed with the storage apparatus 10. Hereinafter, as one example, the courier is supposed to deposit the article from the front face side of the storage apparatus 10.

The courier operates the information input section 15*a* to input a private section information (a room number) of a user to which the article is addressed together with information indicating a request for deposit of an article (step S101).

Then, the control section 11 refers to the usage situation DB 122 to extract information of storage boxes the status of the usage situation of which is "vacant" and makes the display section 14*a* display information of the vacant storage boxes available for deposit (step S102).

When the courier selects a vacant storage box in which the courier intends to deposit using the information input section 15*a* from vacant storage boxes displayed on the display section 14*a* (step S103), the information input section 15*a* outputs a signal identifying the selected storage box to the control section 11.

When the signal identifying the selected storage box is inputted, the control section 11 refers to the usage situation DB 122 to determine whether or not the status of the usage situation of the selected storage box remains "vacant" (step S104).

Here, if it is determined that the status of the usage situation of the storage box is not "vacant", namely, it is "work in progress" or "occupied" (step S104/No) because a user or the like begins the deposit work and unlocks the storage box on the opposite side (back face side) while the courier is performing the deposit work on the front face side, the control section 11 does not unlock the front face side of the selected storage box but returns to step S102 to make the display section 14*a* display a vacant storage box available for deposit.

In this case, the above selected storage box is excluded from the display as vacant storage boxes.

On the other hand, if it is determined that the status of the usage situation of the storage box is "vacant" (step S104/Yes), the control section 11 rewrites the status of the usage situation of the selected storage box from "vacant" to "work in progress" in the usage situation DB 122 (step S105).

Thus, since the storage box turned into "work in progress" for deposit from the front face side is inhibited from being subjected to the deposit work from the back face side, the storage box to which the courier performs the deposit work can be prevented from being opened from the opposite side.

Next, the control section 11 transmits an unlocking signal of the front face side of the selected storage box to the locking and unlocking section 134 of this storage box, and the locking and unlocking section 134 unlocks the front face side of the storage box (step S106).

The courier opens the door of the storage box whose front face side has been unlocked, deposits an article in the storage box and closes the door, or cancels deposition into the unlocked storage box and closes the door.

Here, if an article is deposited in the storage box, the article detection section 135 detects that the article has been deposited and outputs an article detection signal to that effect to the control section 11.

The control section 11 determines whether or not the article detection signal has been inputted from the article detection section 135 (step S107).

If the control section 11 determines that an article detection signal has not been inputted in the control section 11 from the article detection section 135 and an article has not been stored in the storage box (step S107/No), the control section 11 returns the status of the usage situation of the storage box in the usage situation DB 122 from "work in progress" to "vacant" and outputs a locking signal for locking the storage box to the locking and unlocking section 134.

When the locking signal is inputted in the locking and unlocking section 134 from the control section 11, the locking and unlocking section 134 locks the storage box again (step S108) and terminates the procedure.

The storage box having the status of the usage situation rewritten into "vacant" becomes available.

On the other hand, if the control section 11 determines that the article detection signal has been inputted from the article detection section 135 (step S107/Yes), the control section 11 determines that an article has been deposited in a vacant storage box, writes the status of the usage situation of the storage box in the usage situation DB 122 from "work in progress" to "occupied" and outputs a locking signal for locking the storage box to the locking and unlocking section 134.

When the locking signal is inputted from the control section 11, the locking and unlocking section 134 locks the storage box again, restricts deposit (step S109) and terminates the procedure.

The case where the courier deposits an article is described, as an example in this embodiment, but also in a case where a user who is a resident of the apartment house deposits an article, the storage apparatus 10 operates similarly.

As described above, regardless of whether or not the work of depositing or retrieving an article is in progress on the opposite side (the other side opposite to the front face side or the back face side) of the storage apparatus 10, an article can be deposited in the other storage boxes except for the storage box subjected to deposit or retrieval, so that the work efficiency of depositing an article can be significantly improved.

(2) Procedure when an Article is Retrieved

Figure 10:
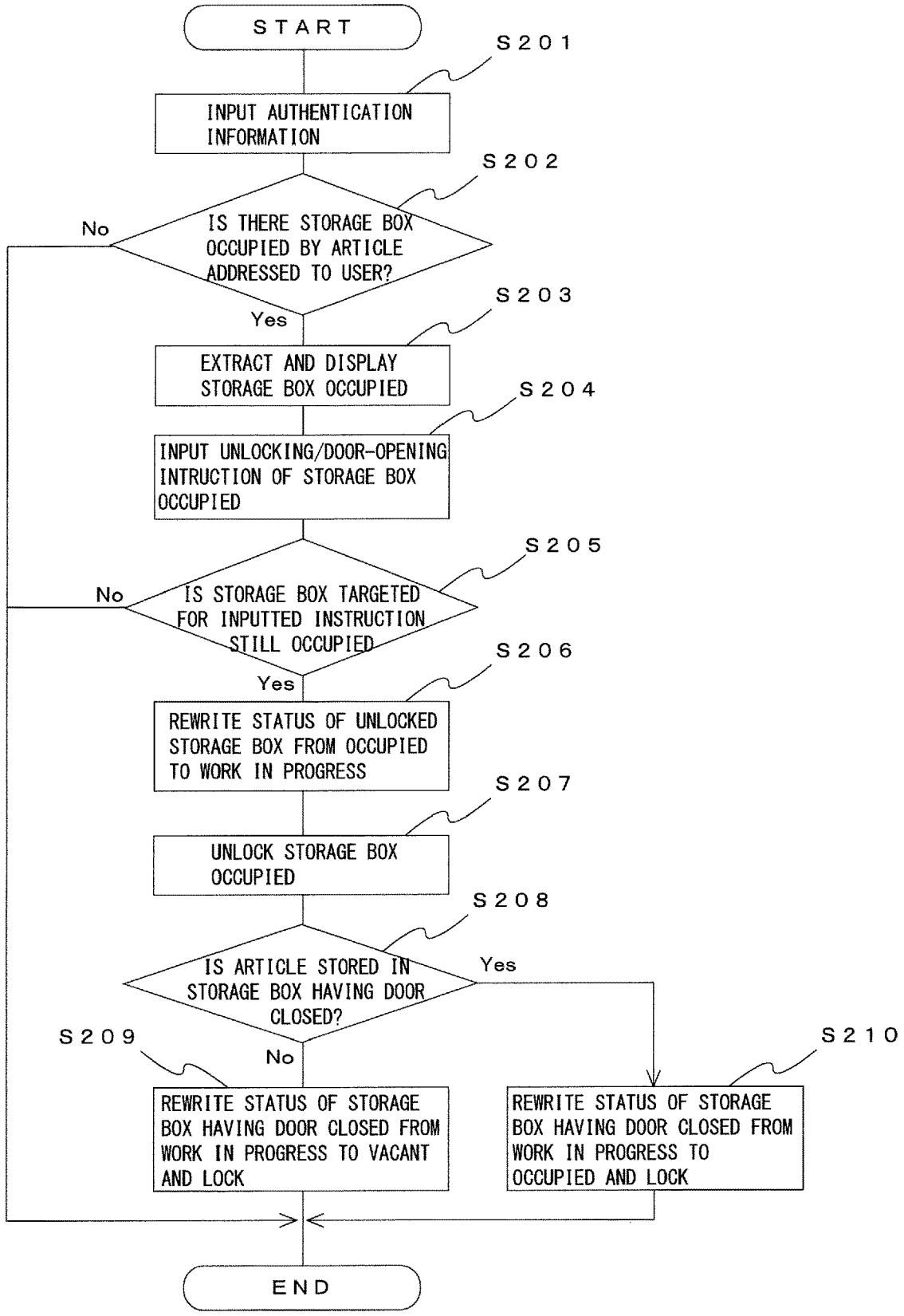
FIG. 10 is a flowchart showing a procedure flow of the storage apparatus at the time of deposit of an article in the first embodiment of the present invention.

FIG. 10 is a flowchart showing a procedure flow taken by the storage apparatus 10 when an article is retrieved from the storage apparatus 10 in the first embodiment of the present invention.

Hereinafter, with reference to FIG. 10, a procedure at the time of retrieving an article is described using an example when a user retrieves an article addressed to himself/herself (a delivery article) from the storage apparatus 10.

First, a user visits an entrance of an apartment house where the storage apparatus 10 storing an article addressed to himself/herself is installed. Hereinafter, as one example, the user is supposed to retrieve the article from the back face side of the storage apparatus 10.

The user operates the information input section 15*b* to input an authentication information of himself/herself together with information indicating a request for retrieval of the article (step S201).

Methods of inputting the authentication information include using a numeric keypad provided in the information inputting section 15*b* to input the authentication information such as a password and using a short-range wireless communication function such as infrared or a code reader function to make the information input section 15*b* read the authentication information written in the information recording medium such as an IC card.

The information input section 15*a* outputs the above inputted authentication information to the control section 11.

When the above authentication information is inputted from the information input section 15*b*, the control section 11 refers to the user DB 121 to identify a user corresponding to the inputted authentication information, and refers to the usage situation DB 122 to determine whether or not there is a storage box "occupied" storing an article addressed to the user (step S202).

That is, the control section 11 determines whether or not there is a storage box "occupied" associated with the private section information of a user (a room number of the apartment house) in the usage situation DB 122.

If the control section 11 determines that there is not a storage box storing the article addressed to the user (step S202/No), the control section 11 terminates the procedure.

On the other hand, if the control section 11 determines that there is a storage box storing an article addressed to the user (step S202/Yes), the control section 11 extracts the storage box storing the article and outputs information of the extracted storage box to the display section 14*b*.

When the information of the storage box is inputted, the display section 14*b* displays the information (step S203).

Here, in this embodiment, there is a case where a plurality of users reside in or use the same facility.

Specifically, for example, there is a case where a plurality of family members reside in an apartment in an apartment house, a plurality of persons work in the same company of an office building, or the like.

Since each user residing in or using the same facility holds the same authentication information in an information recording media or the like, they may try to retrieve the delivery article from both faces of the front face and the back face of the same storage box simultaneously.

In order to prevent the doors 133*a*, 133*b* on both the sides of the storage box from being opened simultaneously in this manner, when the user inputs unlocking/door-opening instruction of the above displayed storage box using the information input section 15*b* (step S204), the control section 11 refers to the usage situation DB 122 to determine whether or not the status of the usage situation of the displayed storage box remains "occupied" (step S205).

At this time, when the user is about to retrieve the delivery article on the back face side, if it is determined that the status of the usage situation of the storage box is not "occupied", namely, it is "work in progress" or "vacant" (step S205/No) because another user or the like has already begun the retrieval work on the opposite side (front face side) and has unlocked the storage box on the front face side, the control section 11 restricts the work of retrieving the delivery article on the back face side, such as by making the display unit 14*b* display the fact that the delivery article has been retrieved from the storage box, and terminates the procedure.

On the other hand, if it is determined that the status of the usage situation of the storage box is "occupied" (step S205/Yes), the control section 11 rewrites the status of the usage situation of the storage box inputted with the unlocking instruction and the door-opening instruction from "occupied" to "work in progress" in the usage situation DB 122 (step S206)

Next, the control section 11 transmits an unlocking signal of the back face side of the storage box to the locking and unlocking section 134 of the storage box and the locking and unlocking section 134 unlocks the back face side of the storage box (step S207).

When the user closes the door after the user opens the unlocked storage box and retrieves the article stored in the storage box, the article detection section 135 performs a detection action to know whether or not the article is still stored in the storage box.

Here, if the user retrieves out the article and the article is not stored in the storage box, the article detection signal is not outputted to the control section 11.

The control section 11 determines whether or not the article detection signal has been inputted from article detection section 135 (step S208).

If the control section 11 determines that the article detection signal has not been inputted from article detection section 135 (step S208/No), the control section 11 determines that the article has been retrieved from the storage box, and rewrites the status of the usage situation of the storage box in the usage situation DB 122 from "work in progress" to "vacant", and outputs a locking signal for locking the storage box to the locking and unlocking section 134.

When the locking signal from the control section 11 is inputted, the locking and unlocking section 134 locks the storage box and restricts deposit (step S209) and terminates the procedure.

Thus, the storage box whose status of the usage situation has been rewritten to "vacant" becomes available for deposit.

On the other hand, when the control section 11 determines that the article detection signal has been inputted from the article detection section 135 (step S208/Yes), the control section 11 determines that the article has not been retrieved from the storage box, and returns the status of the usage situation of the storage box in the usage situation DB 122 from "work in progress" to "occupied" and outputs a locking signal for locking the storage box to the locking and unlocking section 134.

When the locking signal is inputted from the control section 11, the locking and unlocking section 134 locks the storage box again to restrict deposit (step S210), and terminates the procedure.

It is to be noted that the case where a user retrieves an article is described as an example in this embodiment, but, for example, also in a case where a courier delivering an article deposited by a user, or a dry-cleaner or the like picking-up an uncleaned article deposited by a user retrieves an article, the storage apparatus 10 operates similarly.

Further, in the above example, the case where an article is retrieved on the back face side of the storage apparatus 10 is described, but also in a case where an article is retrieved on the front face side, the storage apparatus 10 operates similarly.

As described above, since regardless of whether or not the work of depositing or retrieving an article is being performed on the opposite side of the storage box 10 (the other side opposite to the front face side or the back face side), an article can be retrieved, it is possible to significantly improve the work efficiency of retrieval of an article.

(Conclusion of First Embodiment)

As described above, according to the first embodiment of the present invention, since, regardless of whether or not deposit or retrieval of an article is being performed on one side of the storage apparatus 10, retrieval of an article can be performed and deposit of an article can also be performed on the other side in the storage box except for a storage box which is "occupied" or "work in progress", a user and a courier can perform their work smoothly regardless of the work situation on the other side of the storage apparatus 10, so that an improvement in the work efficiency and the shortening of the work time can be achieved.

Second Embodiment (Summary of Second Embodiment)

In the first embodiment of the present invention, the control section 11 comprehensively performs the action control of the whole storage section 13 (all storage boxes 13*a* to 13*g*) in addition to the action controls of the information storage section 12, the display sections 14*a*, 14*b* and the information input sections 15*a*, 15*b*.

On the other hand, in a second embodiment of the present invention, a plurality of storage boxes 13*a* to 13*g* owned by the storage apparatus 10 are divided into a plurality of groups (two in the following example), and actions of storage boxes belonging to the respective groups are controlled by a plurality of respective different storage control sections.

Then, in this embodiment, the control section 11 performs control of the plurality of storage control sections in addition to the information storage section 12, the display sections 14*a*, 14*b* and the information input sections 15*a*, 15*b*.

The following description is made on the assumption that a configuration and a procedure in the second embodiment of the present invention are similar to those in the first embodiment of the present invention, unless otherwise noted.

(Configuration of Second Embodiment)

Figure 11:
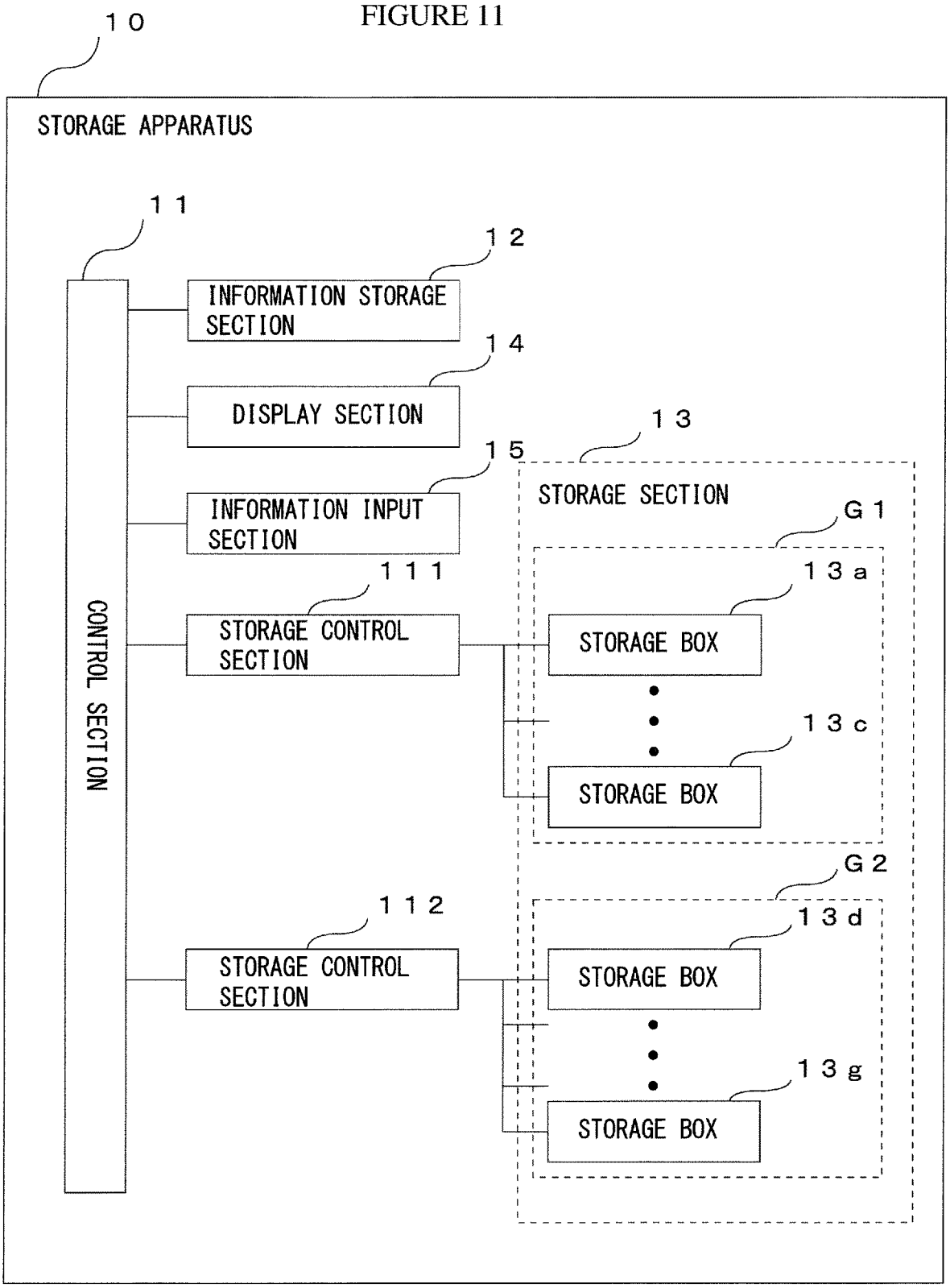
FIG. 11 is a diagram showing a configuration of a storage apparatus in a second embodiment of the present invention.

FIG. 11 is a block diagram showing a configuration of a storage apparatus 10 in the second embodiment of the present invention.

As shown in FIG. 11, similarly to the first embodiment, the storage apparatus 10 in this embodiment is configured to have a control section 11 composed of a CPU or the like for controlling the whole storage apparatus 10, an information storage section 12 for storing various kinds of information, a storage section 13 for storing a delivery article addressed to a user, a display section 14 (including display sections 14*a*, 14*b*) for displaying various kinds of information, and an information input section 15 (including information input sections 15*a*, 15*b*) provided with various keys to enable information input for performing reading of information for authentication written in an information recording medium owned by a user, or the like.

In addition to these constitutional elements, the storage apparatus 10 in this embodiment has storage control sections 111, 112 composed of a CPU or the like for performing action control of the respective storage boxes 13*a* to 13*g* constituting the storage section 13. The procedures of the storage control sections 111, 112 are controlled by the control section 11.

Each of the sections 11 to 15, 111, and 112 is connected to an internal bus, and various pieces of information are inputted/outputted via the bus and various kinds of processing are performed under control of the control section 11.

The storage control sections 111, 112 are processing sections for governing the respective action controls of the two groups of the storage boxes of the storage apparatus 10, and are each composed of an electronic circuit as such a CPU (Central Processing Unit), or an integrated circuit as such an FPGA (Field-Programmable Gate Array).

The storage control sections 111,112 read information from the information storage section 12 and write information in the information storage section 12.

The storage control sections 111, 112 perform action controls of a storage boxes such as locking/unlocking and door-opening/door-closing, authentication processing at the time of use of the storage apparatus 10, management of personal information of a user and usage situation of each storage box, reading of information from each database, writing of information in each database, or the like.

Figure 12:
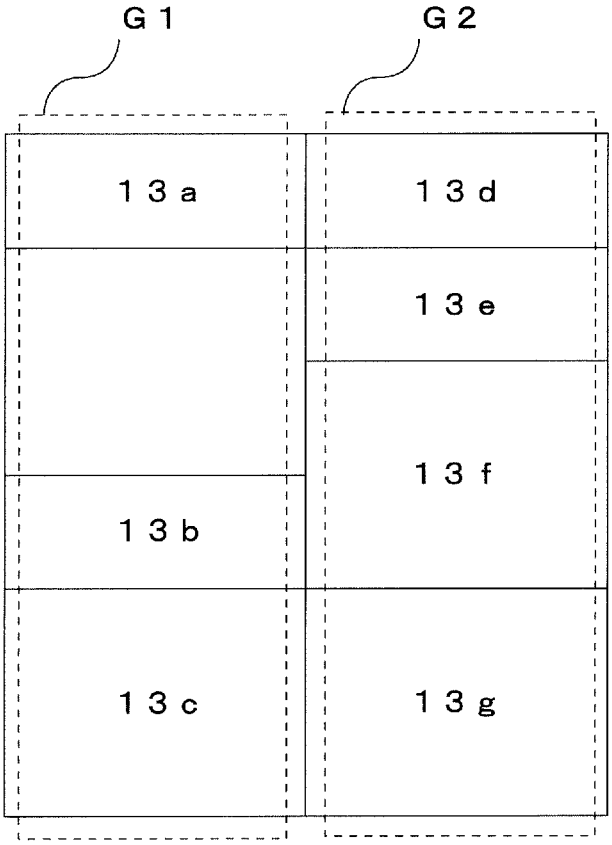
FIG. 12 is a view showing one example of groups of storage boxes in the second embodiment of the invention.

FIG. 12 is a diagram showing one example of groups of storage boxes in the second embodiment of the present invention.

In the example shown in FIGS. 11 and 12, of the storage boxes 13*a* to 13*g*, the storage boxes 13*a* to 13*c* are distributed into a group G1, while the storage boxes 13*d* to 13*g* are distributed into a group G2.

The storage control section 111 performs action controls of the above group G1 (the storage boxes 13*a* to 13*c*), and the storage control section 112 performs action controls of the above group G2 (the storage boxes 13*d* to 13*g*).

It is to be noted that the above grouping of the storage boxes is only one example and the number of groups or the number of storage boxes constituting a group, or the like is not limited to this example.

Further, in this embodiment, "action control of a storage box" means an action control of locking/unlocking of a storage box, and door-opening/door-closing, or the like.

FIG. 13 is a table showing one example of data construction of the usage situation DB 122 in the second embodiment of the present invention.

As shown in FIG. 13, the usage situation DB 122 in this embodiment manages information of each of the groups to which each of the storage boxes 13*a* to 13*g* belongs in addition to the data managed by the usage situation DB 122 in the first embodiment.

In this example of FIG. 13, the storage boxes 13*a* to 13*c* belong to the group G1, and the storage boxes 13*d* to 13*g* belong to the group G2.

In this embodiment, the storage control sections 111, 112 perform action controls of the storage boxes belonging to the groups G1, G2, respectively. Thus, action controls of the storage boxes can be performed smoothly by sharing the action controls of the storage boxes among the plurality of control sections (the storage control section 111, 112) and performing them.

The storage control section 111 performs the action control of only one of the plurality of storage boxes belonging to the group G1 at a time. That is, while the storage control section 111 is being performing the action control of one of the plurality of storage boxes belonging to the group G1, the storage control section 111 does not perform the action control of another storage box belonging to the same group G1.

Further, the storage control section 112 performs the action control of only one of the plurality of storage boxes belonging to the group G2 at a time. That is, while the storage control section 112 is being performing the action control of one of the plurality of storage boxes belonging to the group G2, the storage control section 112 does not perform the action control of another storage box belonging to the same group G2.

Further, even while one of the storage control sections (one storage control section) is performing the action control of a storage box, the other storage control section (another storage control section) can perform the action control of a storage box independently of the one storage box.

(Procedure of Second Embodiment)

(1) Procedure for Depositing an Article

Figure 14:
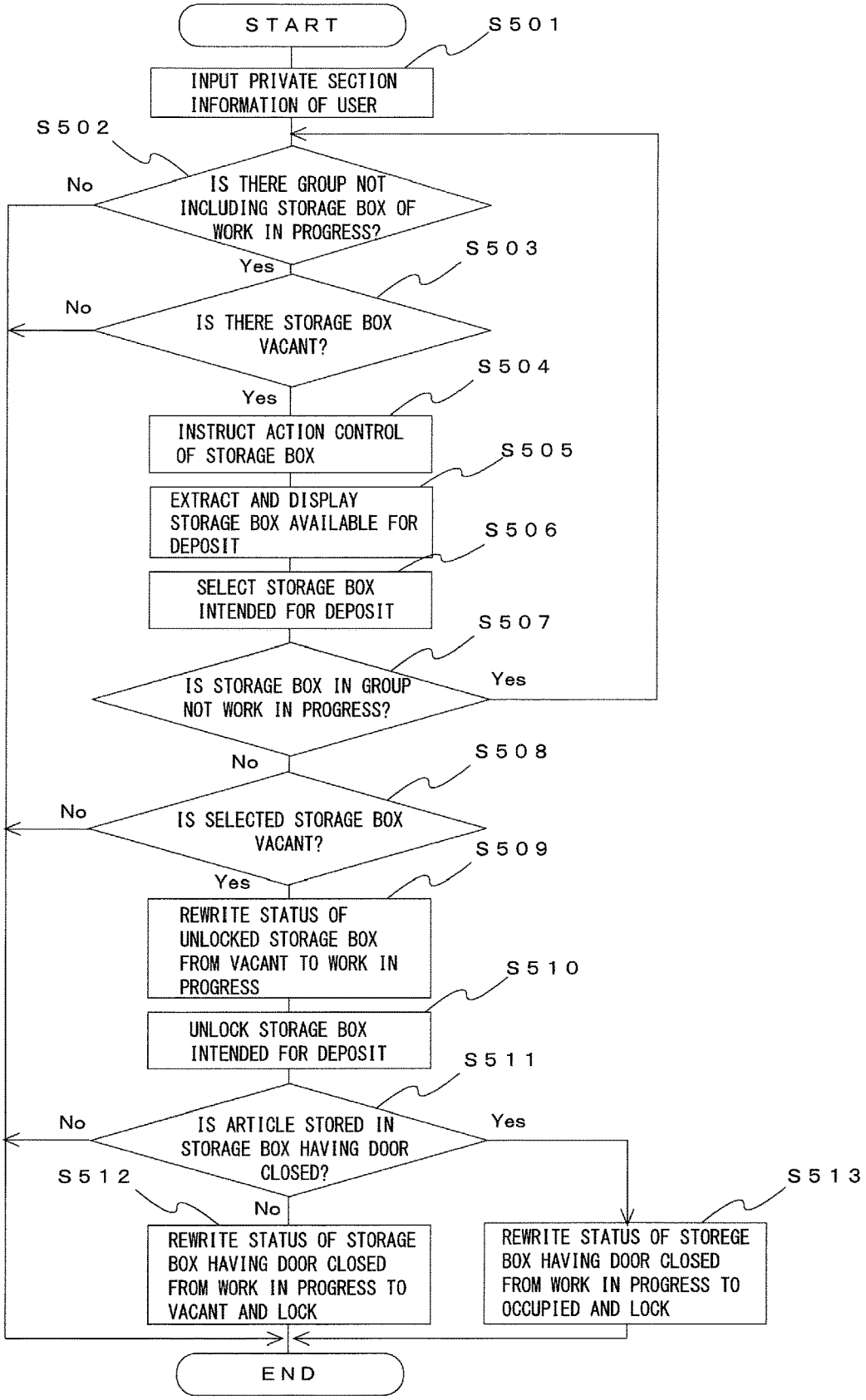
FIG. 14 is a flowchart showing a procedure flow of the storage apparatus at a deposit time of an article in the second embodiment of the invention.

FIG. 14 is a flowchart showing a procedure flow taken by the storage apparatus 10 when an article is deposited in the storage apparatus 10.

With reference to the FIG. 14, a procedure at the time of depositing an article is described below using an example when a courier deposits an article addressed to a user (a delivery article) in the storage apparatus 10.

First, a courier having a delivery article visits an entrance of an apartment house where the storage apparatus 10 is installed. As one example, the courier is supposed to deposit the article from the front face side of the storage apparatus 10.

The courier operates the information input section 15*a* to input a private section information (a room number) of a user to which the article is addressed together with information indicating a request for deposit of an article (step S501).

The information input section 15*a* outputs the inputted private section information to the control section 11.

When the private section information from the information input section 15*a* is inputted, the control section 11 refers to the usage situation DB 122 to determine whether or not there is a group which does not include a storage box the current status of which is "work in progress" (step S502).

Here, if the control section 11 determines that there is not a group which does not include the storage box where the current status is "work in progress" (step S502/No), that means that both the storage control sections 111, 112 are performing the action controls, and cannot newly start the action control of a storage box, so that the procedure is terminated as it is.

On the other hand, if the control section 11 determines that there is a group which does not include a storage box which is "work in progress" at present (step S502/Yes), that means that at least one of the storage control sections 111, 112 is not performing the action control of the storage box and the storage control section, not performing the action control, can newly perform an action control of a storage box.

Next, the control section 11 refers to the usage situation DB 122 to determine whether or not there is a storage box the status of the usage situation of which is "vacant" in the above group which does not include the storage box which is "work in progress" at present (step S503).

Here, if the control section 11 determines that there is not a storage box "vacant" (step S503/No), that means that there is no storage box available for deposit, so that the procedure is terminated as it is.

On the other hand, if the control section 11 determines that there is a storage box "vacant" (step S503/Yes), the control section 11 outputs an instruction signal for the action control of the storage box to the storage control section for performing the action control of the storage box "vacant" (step S504). The control section 11 outputs a private section information which is information identifying the user to the storage control section.

As one example, the following description is made under the assumption that the control section 11 instructs the storage control section 111 to perform the action control of the storage box.

When the instruction signal for the action control of the storage box and the private section information from the control section 11 are inputted, the storage control section 111 refers to the usage situation DB 122 to extract a storage box whose status of the usage situation is "vacant" from the storage boxes belonging to the group G1, and outputs information of a vacant storage box available for deposit to the display section 14*a*.

When the information about the vacant storage box available for deposit is inputted from the storage control section 111, the display section 14*a* displays the inputted information (step S505).

When the courier selects a storage box intended for deposit from the displayed vacant storage boxes using the information input section 15*a* (step S506), the information input section 15*a* outputs information indicating the selected storage box to the control section 11.

When the information of the selected storage box is inputted from the information input section 15*a*, the control section 11 refers to the usage situation DB 122 to determine whether or not the status of the usage situation of either one of storage boxes of the group G1 to which the selected storage box belongs is still not "work in progress" (step S507).

Here, if it is determined that the status of the usage situation of either one of the storage boxes (including the storage box where the courier is working on) of the group G1 is "work in progress" (step S507/Yes) because a user or the like begins the deposit work on the opposite side (back face side) while the courier is performing the deposit work on the front face side of the storage box, the control section 11 does not unlock the front face side of the selected storage box but returns to step S502 to determine whether or not there is a group not including a storage box the status of which is "work in progress" at present.

On the other hand, if it is determined that the statuses of the usage situations of all of the storage boxes of the group G1 (including the storage box which the courier is working on) keeps a state of being not "work in progress", namely, that there is a storage box which is not "work in progress" in the storage boxes of the group G1 (step S507/No), the control section 11 refers to the usage situation DB 122 to determine whether or not the status of the usage situation of the storage box selected at the above step S506 remains "vacant" (step S508).

Here, if it is determined that the status of the usage situation of the storage box is not "vacant", namely, it is "occupied" (step S508/No), because a user or the like has already begun the deposit work on the opposite side (back face side) when the courier is about to deposit on the front face side, the control section 11 does not unlock the front face side of the selected storage box and returns to step S505 and makes the display section 14*a* display a vacant storage box available for deposit.

On the other hand, if the control section 11 determines that the status of the usage situation of the selected storage box is "vacant" (step S508/Yes), the control section 11 outputs information to that effect to the storage control section 111.

When the information to the effect that the status of the usage situation of the selected storage box is in "vacant" from the control section 11, the storage control section 111 rewrites the status of the usage situation of the selected storage box from "vacant" to "work in progress" (step S509).

Thus, since the storage box turned into "work in progress" for deposit from the front face side is inhibited from being subjected to the deposit work from the back face side, the storage box where the courier performs the deposit work can be prevented from being opened from the opposite side.

Next, the control section 11 transmits an unlocking signal for the front face side of the selected storage box to the locking and unlocking section 134 of the storage box, and the locking and unlocking section 134 unlocks the front face side of the storage box (step S510).

The courier opens the unlocked storage box, deposits an article in the storage box and closes the door, or cancels deposit of the vacant and closes the door.

Here, when an article is deposited in the storage box, the article detection section 135 detects deposit of the article and outputs an article detection signal to that effect to the storage control section 111.

The storage control section 111 determines whether or not the article detection signal has been inputted to the storage control section 111 from the article detection section 135 (step S511).

If the storage control section 111 determines that an article detection signal has not been inputted from the article detection section 135 and an article has not been stored in a storage box (step S511/No), the storage control section 111 returns the status of the usage situation of the storage box in the usage situation DB 122 from "work in progress" to "vacant" and outputs a locking signal for locking the storage box to the locking and unlocking section 134.

When the locking signal is inputted from the storage control section 111, the locking and unlocking section 134 locks the storage box again (step S512) and terminates the procedure.

Thus, the storage box whose status of the usage situation has been rewritten to "vacant" becomes available.

On the other hand, if the storage control section 111 determines that an article detection signal has been inputted from the article detection section 135 (step S511/Yes), the storage control section 111 determines that an article is deposited in a vacant storage box, and rewrites the status of the usage situation of the storage box in the usage situation DB 122 from "work in progress" to "occupied" and outputs a locking signal for locking the storage box to the locking and unlocking section 134.

When the locking signal is inputted from the storage control section 111, the locking and unlocking section 134 locks the storage box to restrict deposit (step S513) and terminates the procedure.

It is to be noted that the case where the courier deposits an article is described in this embodiment, but also in a case where a user who is a resident deposits an article, the storage apparatus 10 operates similarly.

Further, in the above example, the case where an article is deposited on the front face side of the storage apparatus 10 is described, but also in a case where an article is deposited on the back face side, the storage apparatus 10 operates similarly.

As described above, according to this embodiment, since the storage apparatus 10 has a plurality of storage control sections for managing a plurality of storage boxes divided into the respective groups, the workload for the action controls at the time of depositing an article in a storage box can be distributed effectively.

Further, even when the deposit or retrieval work of an article is in progress on the opposite side (the other side opposite to the front face side or the back face side), an article can be deposited in a storage box in a group except for the group to which the work-in-progress storage box belongs, so that the work efficiency of deposit of an article can be significantly improved.

(2) Procedure for Retrieving an Article

Figure 15:
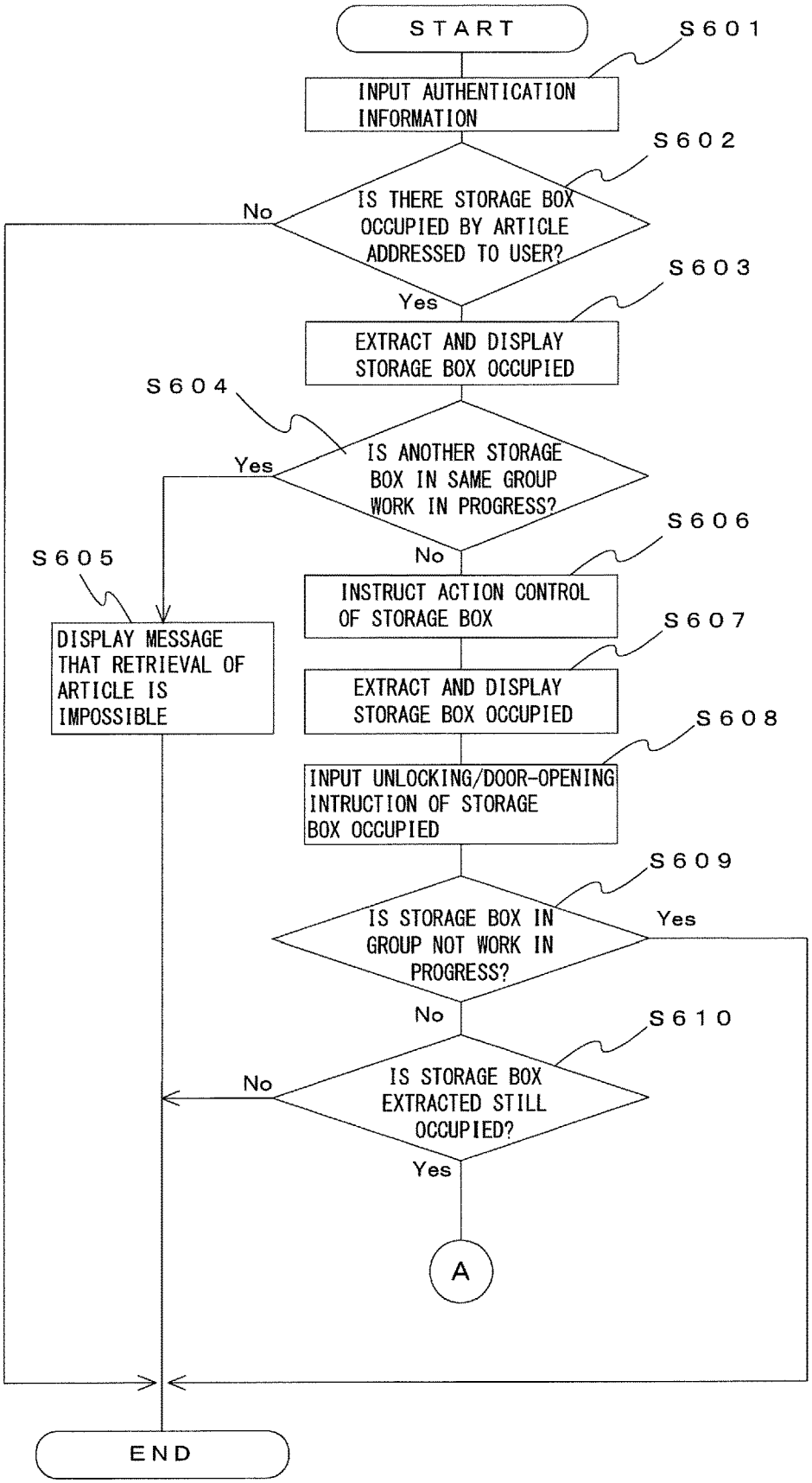
FIG. 15 is a flowchart showing a procedure flow of the storage apparatus at the time of retrieval of an article in the second embodiment of the invention.
Figure 16:
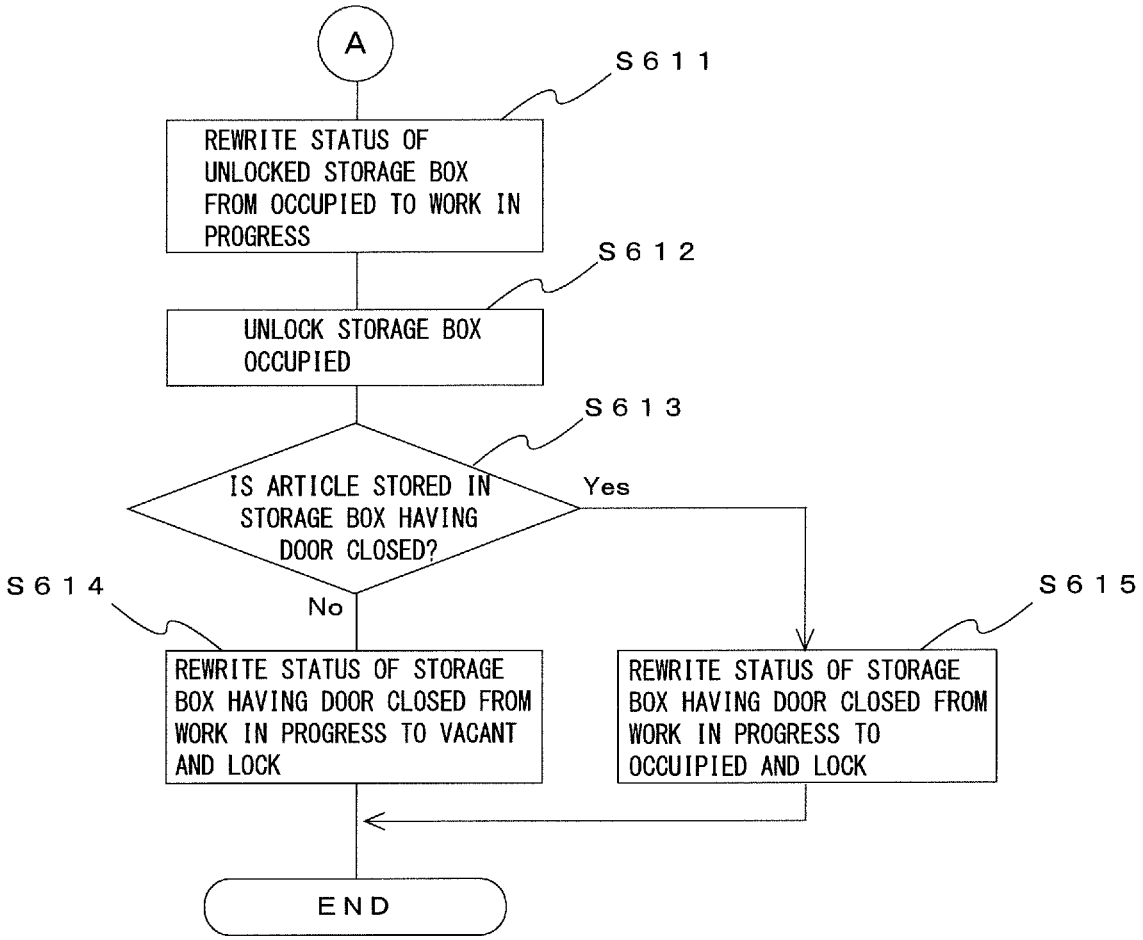
FIG. 16 is a flowchart showing a procedure flow of the storage apparatus at the time of retrieval of an article in the second embodiment of the invention.

FIGS. 15 and 16 are flowcharts showing a procedure flow taken by the storage apparatus 10 when an article is retrieved from the storage apparatus 10 in the second embodiment.

With reference to FIGS. 15 and 16, a procedure taken at the time of retrieving an article is described below using an example when a user retrieves an article addressed to himself/herself (a delivery article) from the storage apparatus 10.

A user first visits an entrance of an apartment house in which the storage apparatus 10 storing an article addressed to himself/herself is installed. Hereinafter, as an example, the user is supposed to retrieve the article from the back face side of the storage apparatus 10.

The user operates the information input section 15*b* to input authentication information about himself/herself together with information indicating a request for retrieval of an article (step S601).

Methods of inputting the authentication information include using a numeric keypad provided in the information inputting section 15*b* to input the authentication information such as a password and using a short-range wireless communication function such as infrared or a code reader function to make the information input section 15*b* read the authentication information written in the information recording medium such as an IC card.

The information input section 15*b* outputs the inputted authentication information to the control section 11.

When the above authentication information is inputted from the information input section 15*b*, the control section 11 refers to the user DB 121 to identify a user corresponding to the read authentication information, and refers to the usage situation DB 122 to determine whether or not there is a storage box "occupied" storing an article addressed to the user (step S602).

That is, the control section 11 determines whether or not there is a storage box "occupied" associated with the private section information (a room number of the apartment house) in the usage situation DB 122.

If the control section 11 determines that there is not a storage box storing the article addressed to the user (step S602/No), the control section 11 terminates the procedure.

On the other hand, when the control section 11 determines that there is a storage box storing an article addressed to the user (step S602/Yes), the control section 11 extracts the storage box storing the article (step S603).

Next, the control section 11 refers to the usage situation DB 122 to determine whether or not another storage box in the group to which the extracted storage box belongs is "work in progress" (step S604).

Here, if the control section 11 determines that the another storage box in the group to which the extracted storage box belongs is "work in progress" (step S604/Yes), that means that the storage control section cannot perform the action control of the storage box storing the article of the user, because the storage control section for performing an action control of the storage box storing the article of the user is being currently performing the action control of another article.

In this case, the control section 11 makes the display section 14*b* display information to the effect that retrieval of an article is unavailable (step S605) and terminates the procedure as it is.

On the other hand, if the control section 11 determines that another storage box in the group to which the extracted storage box belongs is not "work in progress" (Step S604/No), the control section 11 instructs the storage control section for performing the action control of the storage box to perform the action control of the storage box (step S606). The control section 11 delivers the private section information which is information for identifying a user to the storage control section together with this instruction to the storage control section.

As one example, the following description is made on the assumption that the control section 11 instructs the storage control section 111 to perform the action control of the storage box.

When the storage control section 111 receives the instruction of the action control of the storage box from the control section 11, the storage control section 111 refers to the usage situation DB 122 to extract the storage box of the group G1 storing the article of the user and displays the storage box on the display section 14*b* (step S607).

Next, when the user inputs an unlocking/door-opening instruction of the displayed storage box using the information input section 15*b* (step S608), the information input section 15*b* outputs information indicating the unlocking/door-opening instruction of the storage box to the control section 11.

When the information indicating the unlocking/door-opening instruction of the above storage box is inputted from the information input section 15*b*, the control section 11 refers to the usage situation DB 122 to determine whether or not the status of the usage situation of either one of storage boxes in the group G1 to which the storage box instructed to unlock/open belongs is still not "work in progress" (step S609).

Here, if it is determined that the status of the usage situation of either one of the storage boxes of the group G1 is "work in progress" (step S609/Yes) because, when the user is about to begin the retrieval work on the back face side of the storage box, a courier or the like has begun the deposit work or the like on the opposite side (front face side), the control section 11 displays to the user on the display section 14*b* an instruction to retry the work of retrieving the delivery article a little later, and terminates the procedure.

On the other hand, at step S609, if it is determined that the statuses of the usage situations of all the storage boxes (including the storage box on which the user is working on the back face side) are still not "work in progress", namely, a storage box which is not "work in progress" is present among the storage boxes of the group G1 (step S609/No), the control section 11 refers to the usage situation DB 122 to determine whether or not the status of the usage situation of the displayed storage box remains "occupied" (step S610).

If the status of the usage situation of the storage box is not "occupied", namely, the delivery article has been already retrieved from the opposite side (the front face side) (step S610/No), the control section 11 makes the display section 14*b* display that the delivery article has been retrieved from the storage box and terminates the procedure.

On the other hand, if it is determined that the status of the usage situation of the storage box is "occupied" (step S610)/Yes), the control section 11 outputs the information to that effect to the storage control section 111.

When the information to the effect that the status of the usage situation of the selected storage box is "occupied" is inputted from the control section 11, the storage control section 111 rewrites the status of the usage situation of the storage box instructed to unlock/open from "occupied" to "work in progress" in the usage situation DB 122 (step S611).

Next, the control section 11 transmits an unlocking signal of the back face side of the storage box to the locking and unlocking section 134 of the storage box, and the locking and unlocking section 134 unlocks the back face side of the storage box (step S612).

Once the user closes the door after opening the unlocked storage box and retrieving the article stored in the storage box, the storage control section 111 determines whether or not the article detection section 135 had detected at the above closure time that the article has been stored in the storage box (step S613).

If the storage control section 111 determines that storage of an article has not been detected by the article detection section 135 (step S613/No), the storage control section 111 determines that the article has been retrieved from the storage box, and rewrites the status of the usage situation of the storage box in the usage situation DB 122 from "work in progress" to "vacant" (step S614) and terminates the procedure.

Thus, the storage box the status of the usage situation of which has been rewritten to "vacant" becomes available.

On the other hand, if the storage control section 111 determines that storage of an article has been detected by the article detection section 135 (step S612/Yes), the storage control section 111 determines that the article has not been retrieved from the storage box, and returns the status of the usage situation of the storage box in the usage situation DB 122 from "work in progress" to "occupied" and locks the storage box again (Step S614) and the procedure is terminated.

It is to be noted that the example where the user retrieves the article is described in this embodiment, but also in a case where a courier delivering an article deposited by a user or a dry-cleaner or the like picking up an uncleaned article deposited by a user or the like, retrieves an article, the storage apparatus 10 operates similarly.

Further, in the above example, the case where an article is retrieved on the back face side of the storage apparatus 10 is described, but also in a case where an article is retrieved on the front face side, the storage apparatus 10 operates similarly.

As described above, according to this embodiment, since the storage apparatus 10 has a plurality of storage control sections for managing a plurality of storage boxes divided into the respective groups, the workload for the action control at the time of retrieving an article from a storage box can be distributed effectively.

Further, even when the work of depositing or retrieving an article is in progress on the opposite side (the other side opposite to the front face side or the back face side), an article can be retrieved from a storage box in a group except for the group to the work-in-progress storage box belongs, the work efficiency of retrieval of an article can be significantly improved.

(Conclusion of Second Embodiment)

As described above, according to this embodiment, since the storage apparatus 10 has a plurality of storage control sections for managing a plurality of storage boxes dividing into the respective groups, the workload for the action control at the time of retrieving an article from a storage box can be distributed effectively, and the action controls of the storage box can be performed more smoothly.

In particular, when the storage apparatus 10 is installed in an apartment house, it is often the case that many delivery articles are delivered, and that many couriers are intended to deposit or retrieve an article just around the same time, so that it is very effective to provide such a plurality of control sections as described above.

Further, when the work of depositing or retrieving an article is being performed on the opposite side (the other side opposite to the front face side or the back face side), an article can be retrieved from a storage box in a group except for the group to the work-in-progress storage belongs, the work efficiency of retrieval of an article at that time can be significantly improved.

Third Embodiment (Summary of Third Embodiment)

In the first and second embodiments described above, the storage apparatus 10 is configured in a stand-alone manner.

On the contrary, a storage apparatus 10 in a third embodiment of the present invention is connected to a management apparatus which is an information processor via a network.

In this embodiment, the management apparatus performs the action controls of a storage box instead of the storage apparatus 10.

The following description is made on the assumption that a configuration and a procedure in the third embodiment of the present invention are similar to those in the first and second embodiments of the present invention, unless otherwise noted.

(Configuration of Third Embodiment)

(1) Whole Configuration of Storage System

Figure 17:
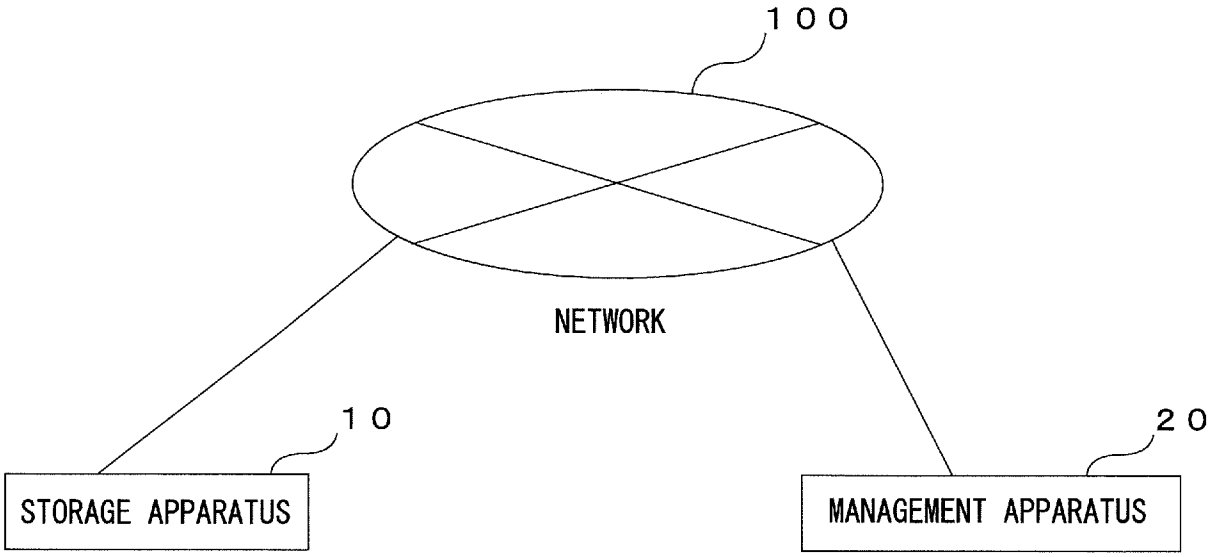
FIG. 17 is a diagram showing a configuration of a storage system in a third embodiment of the present invention.

FIG. 17 is a diagram showing a configuration of a storage system in the third embodiment of the present invention.

As shown in FIG. 17, the storage system is configured by connecting a storage apparatus 10 for storing an article therein and a management apparatus 20 for performing the action control of the storage apparatus 10 to each other via a network 100.

(2) Configuration of Storage Apparatus 10

Figure 18:
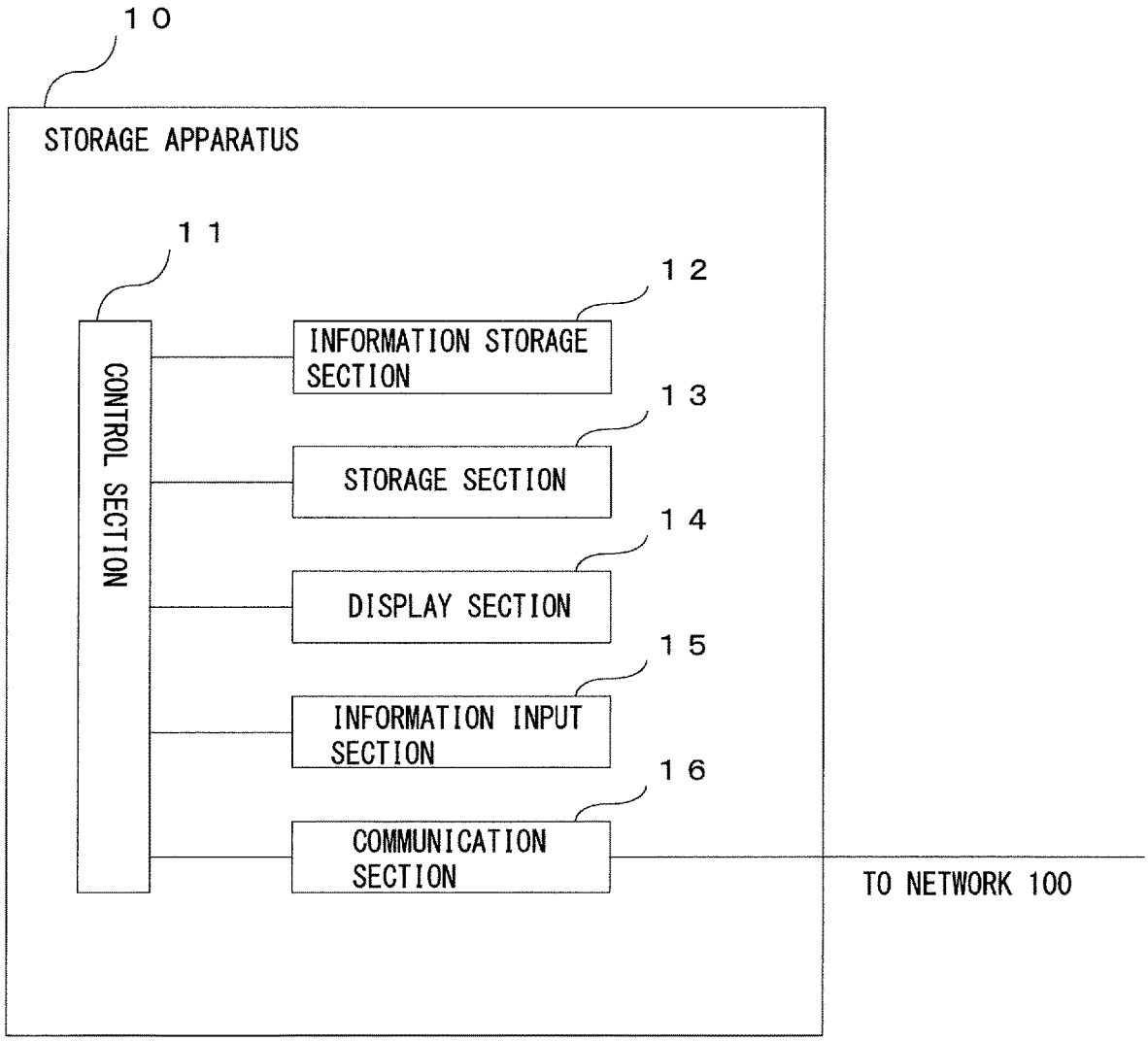
FIG. 18 is a diagram showing a configuration of a storage apparatus in the third embodiment of the present invention.

FIG. 18 is a block diagram showing a configuration of the storage apparatus 10 in the third embodiment of the present invention.

As shown in FIG. 18, the storage apparatus 10 in the third embodiment of the present invention is configured by adding a communication section 16 for performing communication with the management apparatus 20 via the network 110 to the storage apparatuses 10 in the first and second embodiments.

Each of the sections 11 to 16 is connected to an internal bus, various pieces of information or the like is inputted/outputted via the bus to the section 11 to 16, and various kinds of processing are performed under control of the control section 11.

The communication section 16 is an interface for controlling communication with the management apparatus 20 via the network 100, and has a LAN adapter or the like.

The communication section 16 is provided with a wireless transceiver, may be connected to a LAN, the Internet or the like via wireless communication, or may be connected thereto via such a wire as a cable.

Further, in this embodiment, the information storage section 12 does not store the user DB 121 and the usage situation DB 122 therein.

(3) Configuration of Management Apparatus 20

Figure 19:
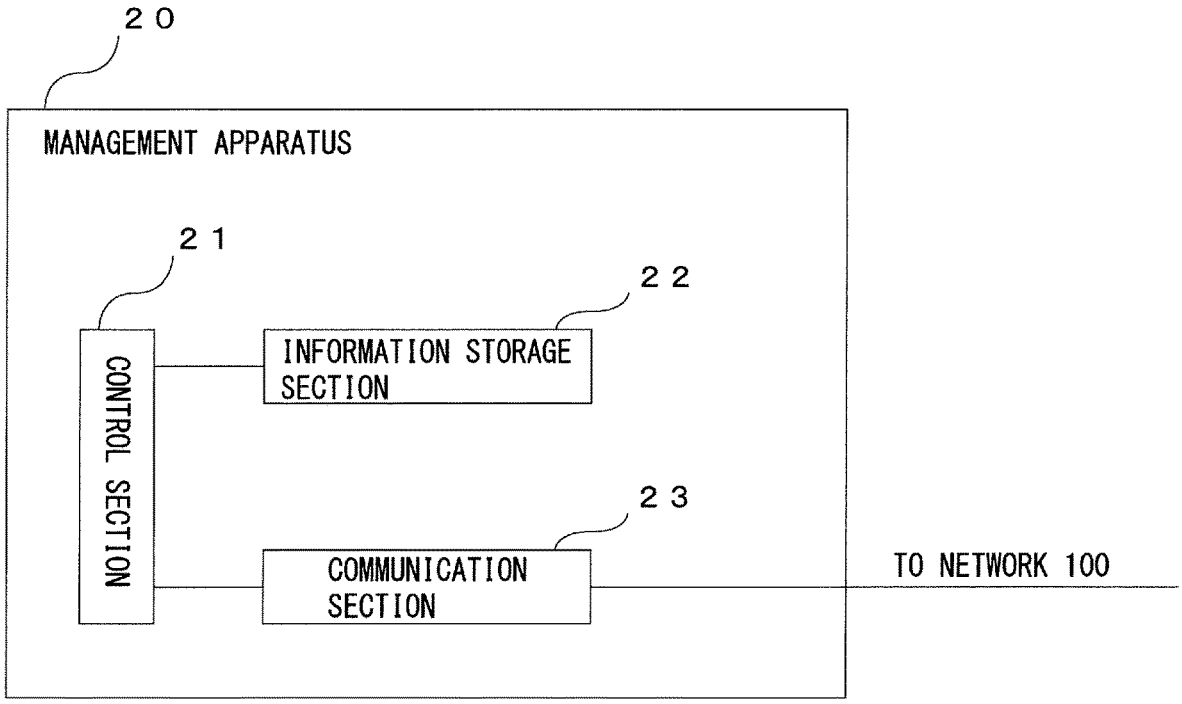
FIG. 19 is a diagram showing a configuration of a management apparatus in the third embodiment of the present invention.

FIG. 19 is a block diagram showing a configuration of the management apparatus 20 in the third embodiment of the present invention.

As shown in FIG. 19, the management apparatus 20 is configured to have a control section 21 for performing the action controls of the storage apparatus 10 and the management apparatus 20, an information storage section 22 for storing various pieces of information therein, and a communication section 23 for performing communication with the storage apparatus 10 via the network 100.

The information storage section 22 stores the user DB 121 and the usage situation DB 122 instead of the information storage section 12 of the storage apparatus 10.

In this embodiment, the management apparatus 20 performs management of information in the databases 121, 122 and substantial action controls of a storage box instead of the storage apparatus 10.

Each of the sections 21 to 23 is connected to an internal bus, various pieces of information or the like is inputted/outputted via the bus, and various kinds of processing are performed under control of the control section 21.

(4) Configuration of Control Section 21

A control section 21 is a processing section for governing control of the whole management apparatus 20, and is composed of, for example, an electronic circuit such as a CPU (Central Processing Unit), or an integrated circuit such as an FPGA (Field-Programmable Gate Array).

The control section 21 reads information from the information storage section 22 and writes information in the information storage section 22.

The control section 21 performs authentication processing at the time of use of the storage apparatus 10, management of personal information of a user and a usage situation of each storage box, or the like instead of the control section 11 of the storage apparatus 10.

(5) Configuration of Information Storage Section 22

The information storage section 22 is an apparatus for storing information therein, such as a hard disk, a memory, a semiconductor device, or the like, for example.

The information storage section 22 has an area for storing a program executed in the control section 21 and/or a workspace or the like (RAM or the like) for being temporarily used when the control section 21 executes processing.

The control section 21 reads a program stored in the information storage section 22, develops the same in the workspace and performs for various kinds of processing.

As described above, the information storage section 22 stores the user DB 121 and the usage situation DB 122 instead of the information storage section 12 of the storage apparatus 10.

The data configurations of the user DB 121 and the usage situation DB 122 stored in the information storage section 22 are similar to those of the user DB 121 and the usage situation DB 122 stored in the information storage section 12 in the first embodiment, the descriptions thereof are omitted.

Further, "usage situation" in the usage situation DB 122 includes three statuses, "occupied", "work in progress", and "vacant", and the control section 21 (CPU) writes either one of these statuses on a basis of a detection result obtained by an article detection section 235 provided in each storage box and described later, or the like.

When an article is stored in a storage box and the door is closed and locked, the control section 21 (CPU) writes a usage situation of the storage box as "occupied". In this case, the control section 21 (CPU) also writes private section information of a user to which the article is addressed in association with box identifying information of the corresponding storage box.

On the other hand, when an article is not stored in a storage box and the door is closed, the control section 21 (CPU) writes "vacant" in the usage situation of the storage box.

Further, when the storage box is being opened in order to deposit or retrieve an article regardless of whether or not an article is being stored in the storage box, the control section 21 (CPU) writes "work in progress" in the usage situation of the storage box. When the work of depositing an article is terminated and the storage box is closed and locked again, the control section 21 (CPU) rewrites the usage situation of the storage box to "occupied". On the other hand, when the work of retrieving an article is terminated and the storage box is door-closed again, the control section 21 (CPU) rewrites the usage situation of the storage box into "vacant".

(Procedure of Third Embodiment)

In this embodiment, information inputted from the information input sections 15*a*, 15*b* of the storage apparatus 10 is transmitted to the management apparatus 20 via the network 100 by the communication section 16.

When the management apparatus 20 receives the information from the storage apparatus 10, the control section 21 of the management apparatus 20 refers to the databases 111, 112 on a basis of the information received from the storage apparatus 10 to perform an information extraction processing, an authentication processing and the like which are performed by the control sections 11 of the storage apparatuses 10 in the first and second embodiments, and outputs information of the processed resulting from the processing to the communication section 23.

The communication section 23 transmits the information resulting from the processing inputted from the control section 21 to the storage apparatus 10.

The storage apparatus 10 performs the action control of the storage box or display processing of the display sections 14*a*, 14*b* on a basis of the information resulting from the processing received from the management section 20.

(Conclusion of Third Embodiment)

As described above, according to the third embodiment, since the management apparatus 20 manages personal information of users, the usage situations of the storage boxes, and the like instead of the storage apparatus 10, the workload of the storage apparatus 10 can be reduced and the efficiency of the work of deposit or retrieval of an article can be improved like the first and second embodiments regardless of the configuration of the storage apparatus 10 not provided with the databases.

It is to be noted that the control section 21 of the management apparatus 20 performs an information extraction processing, an authentication processing and the like in the third embodiment described above, but storage boxes may be divided into a plurality of groups like the second embodiment and the management apparatus 20 may be configured to be provided with a plurality of storage control sections for performing substantial action controls of the respective groups.

In this case, information resulting from the processing performed by each storage control section is transmitted from the management apparatus 20 to the storage apparatus 10, and the storage apparatus 10 performs the action control of the storage box, display processing and the like on a basis of the information resulting from the processing received from the management apparatus 20.

Conclusion of Embodiments

As described above, according to the first to third embodiments of the present invention, in the storage apparatus 10 capable of deposit and retrieval of an article on both sides of the front and back face sides of the storage apparatus 10, even if when the work is being performed on one side, work can be performed on the other side, so that the efficiency of working on an article can be improved.

The above-described storage apparatus 10 and management apparatus 20 can be embodied mainly by a CPU and a program loaded in a memory. However, it is also possible to configure these apparatuses 10 and 20 or server by a combination of any hardware and software other than the above, and those skilled in the art would readily understand its high degree of design freedom.

Further, when the above-described storage apparatus 10 or management apparatus 20 are configured as a software module group, this program may be recorded on such a recording medium as an optical recording medium, a magnetic recording medium, a magneto-optical recording medium, or a semiconductor, and may be loaded from the above-described recoding medium, or may be loaded from an external apparatus connected via a predetermined network.

It is to be noted that the above-described embodiments are examples of preferred embodiments of the present invention, and embodiments of the present invention are not limited to these preferred embodiments, and the present invention can be variously modified to be implemented without departing from the gist of the present invention For example, in the embodiments described above, the storage box of the storage apparatus 10 is provided with the deposit and retrieval ports on the front face side thereof and the back face side opposite thereto, but positions of installations of the deposit and retrieval ports are not limited to the above embodiments as long as a plurality of deposit and retrieval ports are provided.

Further, according to each embodiment described above, the operation unit 21*a* (the display section 14*a* and the information input section 15*a*) is used when a deposit or retrieval work is performed at the deposit and retrieval port 132*a* on the front face side of the storage box, whereas the operation unit 21*b* (the display section 14*b* and the information input section 15*b*) is used when a deposit or retrieval work is performed at the deposit and retrieval port 132*b* on the back face side of the storage box, but each of the operation units 21*a*, 21*b* may be configured to also be used when various works are performed at a deposit and retrieval port on another face side except for the front face side or the back face side.

For example, the operation unit 21*a* may be configured to also be used when the operation unit 21*a* performs various works at a deposit and retrieval port opened on the front face side and on another face side continuous to or non-continuous to the front face side (a side face or the like).

Thus, faces of the deposit and retrieval ports for which one operation unit is used during various works are regarded as the same face in each of the above embodiments, and all of the faces regarded as the same face are collectively expressed as "substantially the same face".

Therefore, for example, in the first embodiment, while one operation unit is operating during the work, the work can be performed at a deposit and retrieval port on another face other than substantially the same face as the deposit and retrieval port for which the operation unit is used except for the storage box where the work is being actually performed.

In a case that the locking and unlocking section is of mechanical type, when a key is inserted into/turned in a keyhole provided in the locking and unlocking section itself, or a dial provided on the locking and unlocking section itself is adjusted to a state meeting an unlocking condition, the locking and unlocking section unlocks to make the door freely operable, so that a user or a courier person in charge can deposit or retrieve an article in/from a storage box.

EXPLANATION OF REFERENCE SIGNS

10 storage apparatus
11, 21 control section
12, 22 information storage section
13 storage section
13*a* to 13*g* storage box
14, 14*a*, 14*b* display section
15, 15*a*, 15*b* information input section
16, 23 communication section
20 management apparatus
21*a*, 21*b* operation unit
100 network
111, 112 storage control section
121 user DB
122 usage situation DB
131 storage chamber
132*a*, 132*b* deposit and retrieval port
133*a*, 133*b* door
134 locking and unlocking section
135 article detection section
137*a*, 137*b* hinge portion
138*a*, 138*b* hook
139*a*, 139*b* hook hole
139*c* door-opening and door-closing detection section

What is claimed is:

1. A storage apparatus for depositing and retrieving an article, the storage apparatus comprising:

a storage section having a plurality of lockable and unlockable storage boxes each provided with a plurality of deposit and retrieval ports, the deposit and retrieval ports including openable and closable doors;

a locking and unlocking section for locking and unlocking the storage boxes individually and detecting situations of opening or closing of the doors;

a control section having a CPU for controlling an action of the storage apparatus; and a database for managing usage situations of the storage boxes;

wherein when the control section recognizes, on a basis of the database, that work of deposit or retrieval of an article is being performed at one of the deposit and retrieval ports of one of the storage boxes, and that a request has been made for deposit or retrieval of an article from another storage box among the plurality of storage boxes, the control section outputs a locking signal for the door of another deposit and retrieval port of the storage box to the locking and unlocking section to restrict deposit or retrieval of an article regarding the other deposit and retrieval port, and outputs a door unlocking signal regarding the other storage box among the plurality of storage boxes to allow deposit or retrieval of an article from the other storage box.

2. The storage apparatus according to claim 1, wherein when the control section recognizes that work of deposit or retrieval of an article is being performed at one deposit and retrieval port of one of the storage boxes, the control section outputs, regarding the other storage box, a door unlocking signal regarding another deposit and retrieval port by using an operation unit different from an operation unit used when work is performed at the deposit and retrieval port where the work is being performed to allow deposit or retrieval of an article at the other deposit and retrieval port.

3. The storage apparatus according to claim 2, wherein when the control section recognizes that work of deposit or retrieval of an article is being performed at one of the deposit and retrieval ports of one of the storage boxes, the control section outputs, regarding the other storage box, a door unlocking signal regarding another deposit and retrieval port which is not provided on substantially a same face as the deposit and retrieval port where the work is being performed to allow deposit or retrieval of an article at the other deposit and retrieval port.

4. The storage apparatus according to claim 1, wherein when the control section recognizes that work of deposit or retrieval of an article is being performed at one of the deposit and retrieval ports of one of the storage boxes, the control section outputs, regarding the other storage box, a door unlocking signal regarding another deposit and retrieval port which is not provided on substantially a same face as the deposit and retrieval port where the work is being performed to allow deposit or retrieval of an article at the other deposit and retrieval port.

5. A storage apparatus for depositing and retrieving an article, the storage apparatus comprising:

a storage section having a plurality of lockable and unlockable storage boxes each provided with a plurality of deposit and retrieval ports, the deposit and retrieval ports including openable and closable doors;

a locking and unlocking section for locking and unlocking the storage boxes individually and detecting situations of opening or closing of the doors;

a control section having a CPU for controlling an action of the storage apparatus;

a database for allocating the plurality of storage boxes to a plurality of groups, respectively, and managing of usage situations of the storage boxes; and a plurality of storage control sections each having a CPU for performing an action control of storage boxes for each of the groups;

wherein when the control section recognizes, on a basis of the database, that work of deposit or retrieval of an article is being performed at one of the storage boxes, the control section restricts deposit or retrieval of an article regarding all other storage boxes belonging to a same group as the storage box that work of the deposit or retrieval of the article is being performed, and outputs an action control signal to the storage control section for performing an action control of another group to allow deposit or retrieval of an article regarding the storage boxes of the other group, the other group being different from the group to which the storage box, where the work is being performed, is allocated.

6. The storage apparatus according to claim 5, wherein when the control section recognizes that work of deposit or retrieval of an article is being performed at one of the deposit and retrieval ports of a storage box of the plurality of storage boxes, the control section allows, regarding the other storage boxes, deposit or retrieval of an article at a deposit and retrieval port using an operation unit different from an operation unit used when the work is performed at the deposit and retrieval port where the work is being performed.

7. The storage apparatus according to claim 6, wherein when the control section recognizes that work of deposit or retrieval of an article is being performed at one of the deposit and retrieval ports of the storage box, the control section allows deposit or retrieval of an article at another deposit and retrieval port which is not provided on substantially a same face as the deposit and retrieval port regarding the storage boxes allocated to the other group.

8. The storage apparatus according to claim 5, wherein when the control section recognizes that work of deposit or retrieval of an article is being performed at one of the deposit and retrieval ports of the storage box, the control section allows deposit or retrieval of an article at another deposit and retrieval port which is not provided on substantially a same face as the deposit and retrieval port regarding the storage boxes allocated to the other group.

9. A storage system having a storage apparatus and a management apparatus connected to the storage apparatus via a network, the storage system comprising:

the storage apparatus including:

a storage section having a plurality of lockable and unlockable storage boxes each provided with a plurality of deposit and retrieval ports for depositing and retrieving an article, the deposit and retrieval ports including openable and closable doors; and a locking and unlocking section for unlocking each of the storage boxes and detecting situations of opening or closing of the doors; and the management apparatus including:

a control section having a CPU for controlling an action of the storage apparatus; and a database for managing usage situations of the storage boxes;

wherein when the control section recognizes that work of deposit or retrieval of an article is being performed at one of the deposit and retrieval ports of a storage box, the control section restricts one of the deposit or retrieval of an article at another deposit and retrieval port of the storage box on a basis of the database, and transmits control information to the storage apparatus to allow the doors to be unlocked to deposit or retrieve an article regarding another storage box.

10. A storage system configured to have a storage apparatus and a management apparatus connected to the storage apparatus via a network, the storage system comprising:

the storage apparatus including:

a storage section having a plurality of lockable and unlockable storage boxes each provided with a plurality of deposit and retrieval ports for depositing and retrieving an article, the deposit and retrieval ports including openable and closable doors; and a locking and unlocking section for locking and unlocking each of the storage boxes and detecting situations of opening or closing of the doors; and the management apparatus including:

a control section having a CPU for controlling an action of the storage apparatus;

a database for allocating the plurality of storage boxes to a plurality of groups and managing usage situations of the storage boxes; and a plurality of storage control sections each having a CPU for performing an action control of storage boxes for each of the groups;

wherein when the control section recognizes, on a basis of the database, that work of deposit or retrieval of an article is being performed at one of the deposit and retrieval ports of the storage box, the control section restricts deposit or retrieval of an article regarding all other storage boxes belonging to a same group as the storage box that work of the deposit or retrieval of the article is being performed, and outputs an action control signal to a storage control section for performing the action control of another group to allow deposit or retrieval of an article regarding the storage boxes of the other group, the other group being different from the group to which the storage box, where the work is being performed, is allocated.

* * * * *